US009310707B2

(12) United States Patent
Seki et al.

(10) Patent No.: US 9,310,707 B2
(45) Date of Patent: Apr. 12, 2016

(54) PROCESS CARTRIDGE CAPABLE OF SUPPRESSING FILMING AND IMAGE FORMING APPARATUS WITH SAME

(71) Applicants: Hideyasu Seki, Chiba (JP); Satoshi Hatori, Kanagawa (JP); Takeshi Fukao, Kanagawa (JP); Yuta Kawashima, Kanagawa (JP)

(72) Inventors: Hideyasu Seki, Chiba (JP); Satoshi Hatori, Kanagawa (JP); Takeshi Fukao, Kanagawa (JP); Yuta Kawashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/561,094

(22) Filed: Dec. 4, 2014

(65) Prior Publication Data

US 2015/0160587 A1 Jun. 11, 2015

(30) Foreign Application Priority Data

Dec. 6, 2013 (JP) ..... 2013-253682

(51) Int. Cl.
*G03G 15/02* (2006.01)
*G03G 21/00* (2006.01)

(52) U.S. Cl.
CPC ..... *G03G 15/0275* (2013.01); *G03G 15/0233* (2013.01); *G03G 21/0029* (2013.01)

(58) Field of Classification Search
CPC ..... G03G 15/0233; G03G 15/0216; G03G 15/0275; G03G 15/168; G03G 2221/0026; G03G 2221/1609; G03G 21/0029
See application file for complete search history.

(56) References Cited

U.S. PATENT DOCUMENTS

| | | | | |
|---|---|---|---|---|
| 5,459,558 | A * | 10/1995 | Ishiyama | 399/176 |
| 5,576,805 | A * | 11/1996 | Ishihara et al. | 399/176 |
| 7,529,498 | B2 * | 5/2009 | Kitagawa et al. | 399/100 |
| 7,773,906 | B2 * | 8/2010 | Matsumoto et al. | 399/100 |
| 2005/0100804 | A1 * | 5/2005 | Tamoto et al. | 430/66 |
| 2005/0191081 | A1 * | 9/2005 | Muraishi et al. | 399/100 |
| 2006/0115292 | A1 | 6/2006 | Sampe et al. | |
| 2007/0059035 | A1 | 3/2007 | Yoshino et al. | |
| 2007/0122180 | A1 * | 5/2007 | Miyaji | 399/100 |
| 2008/0304843 | A1 | 12/2008 | Kosuge et al. | |
| 2009/0052939 | A1 | 2/2009 | Yoshino et al. | |
| 2009/0060554 | A1 | 3/2009 | Kosuge et al. | |
| 2009/0185842 | A1 | 7/2009 | Hatori et al. | |
| 2010/0129126 | A1 | 5/2010 | Kosuge et al. | |
| 2010/0189461 | A1 | 7/2010 | Shintani et al. | |
| 2010/0316422 | A1 | 12/2010 | Amemiya et al. | |

(Continued)

FOREIGN PATENT DOCUMENTS

| | | |
|---|---|---|
| JP | 2005-301216 | 10/2005 |
| JP | 2007-086531 | 4/2007 |

*Primary Examiner* — David Gray
*Assistant Examiner* — Carla Therrien
(74) *Attorney, Agent, or Firm* — Duft Bornsen & Fettig LLP

(57) ABSTRACT

An image forming apparatus includes a latent image bearer, an electric charging member to electrically charge the latent image bearer uniformly while forming an electric charging nip therebetween by contacting the latent image bearer. A value obtained by dividing a moment of inertia of area of the latent image bearer by the cube of length thereof ranges from about 0.000058 [mm] or more to about 0.000145 [mm] or less. A width of the electric charging nip in a direction of rotation at longitudinal ends of the latent image bearer is larger than that at a longitudinal center thereof. A difference between the width of the electric charging nip in the direction of rotation at the longitudinal ends of the latent image bearer and that at the longitudinal center thereof is larger than an amount of deformation of the latent image bearer generated during rotation at the longitudinal center thereof.

20 Claims, 13 Drawing Sheets

(56) References Cited

U.S. PATENT DOCUMENTS

| | | | | |
|---|---|---|---|---|
| 2011/0026992 | A1 | 2/2011 | Shintani et al. | |
| 2011/0274447 | A1 | 11/2011 | Arai et al. | |
| 2012/0063815 | A1 | 3/2012 | Seki et al. | |
| 2013/0058667 | A1* | 3/2013 | Iwasaki | 399/43 |
| 2014/0147170 | A1 | 5/2014 | Taguchi et al. | |
| 2015/0003873 | A1* | 1/2015 | Sato et al. | 399/176 |

* cited by examiner

PROCESS CARTRIDGE CAPABLE OF SUPPRESSING FILMING AND IMAGE FORMING APPARATUS WITH SAME

CROSS-REFERENCE TO RELATED APPLICATION

This patent application is based on and claims priority pursuant to 35 U.S.C. §119(a) to Japanese Patent Application No. 2013-253682, filed on Dec. 6, 2013 in the Japan Patent Office, the entire disclosure of which is hereby incorporated by reference herein.

BACKGROUND

1. Technical Field

Embodiments of this invention relates to an image forming apparatus, such as a copy machine, a facsimile, a printer, etc., and a process cartridge used in the image forming apparatus.

2. Related Art

In general, in an image forming apparatus, a surface of a latent image bearer such as a photoconductive drum, etc., is charged uniformly by an electric charging device to have a desired potential thereon. Subsequently, an electrostatic latent image is formed by irradiating the surface of the latent image bearer bearing the above-described electric charge with a light beam. Then, a toner image is formed by applying toner to the electrostatic latent image. Subsequently, the toner image formed in this way on the latent image bearer is either indirectly transferred onto a recording medium via an intermediate transfer member or directly transferred onto the recording medium, thereby ultimately forming a toner image on the recording medium. Toner residue left on the surface of the latent image bearer is then removed by a cleaning unit after the toner image is transferred therefrom.

In a conventional system, a drum-shaped latent image bearer is employed, and an electric charging roller is provided as an electric charging device to contact the drum-shaped latent image bearer while moving its surface. A cleaning blade is also provided in the conventional system while contacting a surface of the drum-shaped latent image bearer. In such a system, since a surface of the latent image bearer is relatively rarely degraded by electrical discharge applied thereto during an electric charging process when compared to a system that employs a non-contact electric charging device, the contact-type system is more preferable for the latent image bearer when used for a long time. Also, in general, a system that employs a cleaning blade that contacts a surface of a latent image bearer as a cleaning unit can effectively remove toner and clean the surface of the latent image bearer even with a simple structure.

Because it is now important, to downsize the image forming apparatus, a latent image bearer is accordingly downsized. For example, to reduce the weight of the latent image bearer, a drum-shaped cylindrical base material is thinned.

Further, to form an image on a sheet having a special size (329 [mm]×483 [mm]) slightly larger than an A3 size (JIS: 297 [mm]×420 [mm]) by one size, the latent image bearer is elongated in an axial direction thereof (i.e., widened).

SUMMARY

Accordingly, one aspect of the present invention provides a novel image forming apparatus that includes a rotatable latent image bearer, a rotatable electric charging member that electrically charges the surface of latent image bearer uniformly while forming an electric charging nip therebetween by contacting the surface of the latent image bearer, and a latent image writing device to form an electrostatic latent image on the surface of the latent image bearer uniformly charged by the electric charging member. A developing unit is provided to apply toner to and develop the electrostatic latent image borne on the latent image bearer. A transfer device is provided to transfer a toner image rendered visible by the toner adhering to the latent image bearer onto a transfer medium in a transfer process. A cleaning unit is provided to remove residual toner remaining on the latent image bearer after the toner image is transferred onto the transfer medium in the transfer process. An electric charging member cleaning unit is provided to remove foreign substances adhering to the surface of the electric charging device. A value obtained by dividing a moment of inertia of area of the latent image bearer by the cube of length of the latent image bearer ranges from about 0.000058 [mm] or more to about 0.000145 [mm] or less. A width of the electric charging nip in a direction of rotation at longitudinal ends of the latent image bearer is larger than that at a longitudinal center thereof. A difference between the width of the electric charging nip in the direction of rotation at the longitudinal ends of the latent image bearer and that at the longitudinal center thereof is larger than an amount of deformation of the latent image bearer generated during rotation at the longitudinal center thereof.

Another aspect of the present invention provides a process cartridge attachable to a body of the image forming apparatus includes a rotatable latent image bearer, a rotatable electric charging member contacting the surface of the latent image bearer to form an electric charging nip therebetween and electrically charge the surface of latent image bearer uniformly, and a cleaning unit to remove residual toner remaining on the latent image bearer after the toner image is transferred onto a transfer medium in the transfer process. Further, the latent image bearer, the electric charging device, and the cleaning unit are integrated as a unit.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
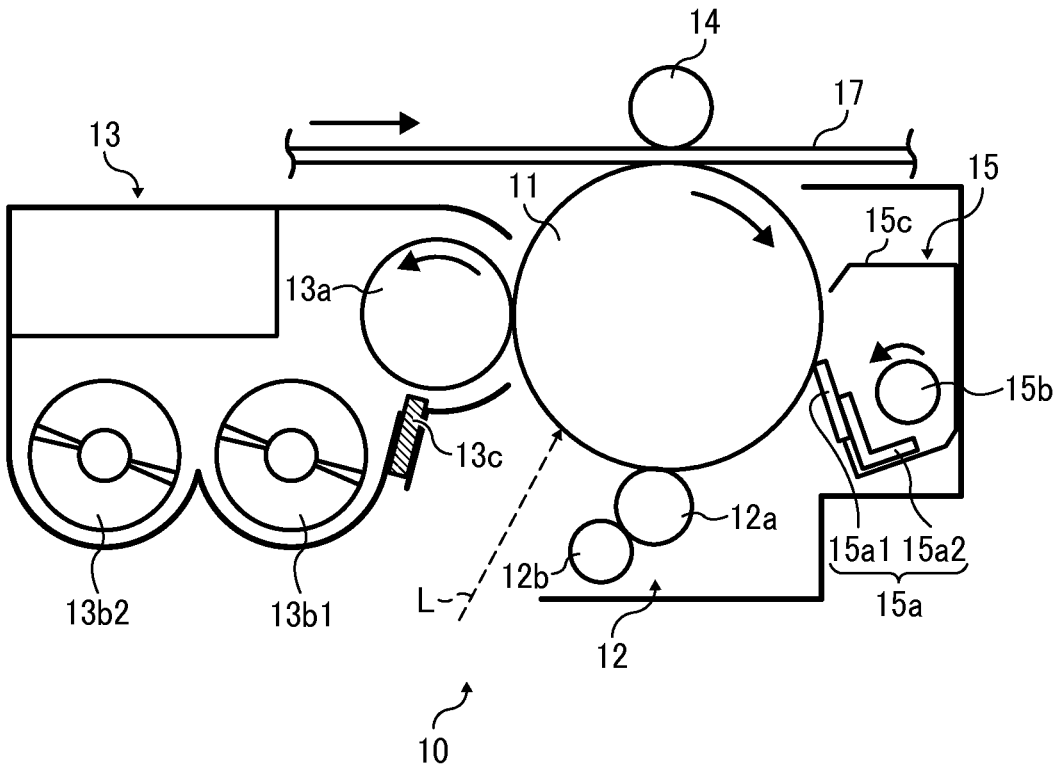
FIG. 1 is a diagram schematically illustrating an exemplary image forming apparatus according to one embodiment of the present invention.

Because it is now important, to downsize the image forming apparatus, a latent image bearer is accordingly downsized. For example, to reduce the weight of the latent image bearer, a drum-shaped cylindrical base material is thinned.

Further, to form an image on a sheet having a special size (329 [mm]×483 [mm]) slightly larger than an A3 size (JIS: 297 [mm]×420 [mm]) by one size, the latent image bearer is elongated in an axial direction thereof (i.e., widened).

However, when an image is formed in an image forming apparatus that employs a latent image bearer with a thick base material having a small outer diameter and a prescribed width capable of handling the special size sheet, silica acting as an external additive used in the toner adheres to an end or ends of the latent image bearer in the axial direction thereof, thereby generating so-called filming thereon before the image forming apparatus arrives at the end of its useful life even during image formation. When the filming occurs on the surface of the latent image bearer in this way, an amount of toner per unit area on the surface of the latent image bearer varies during a developing process, thereby generating density unevenness.

The reduction in diameter, thinning of the base material, and elongation all contribute to render the latent image bearer easily deformable. Moreover, in a system using an electric charging roller, the electric charging roller presses against the latent image bearer perpendicularly to the axis of the latent image bearer. Also, in a system using a contact-type cleaning blade, the cleaning blade also presses against the latent image bearer perpendicularly to the axis of the latent image bearer. Accordingly, as the latent image bearer rotates, the latent image bearer is subjected to a prescribed friction force in an abutment part of the latent image bearer contacted by the cleaning blade in an opposite direction to a direction of rotation of the latent image bearer. The force exerted in the opposite direction to the direction of rotation is also directed perpendicularly to the axis of the latent image bearer. Thus, when the force acts on the latent image bearer perpendicularly to the axis thereof, the latent image bearer deforms in the same direction as the force acting thereon.

With a conventional latent image bearer that deforms less easily than the above-described deflective latent image bearer, problems caused by the deformation thereof are not apparent. On the other hand, with the newer and more compact latent image bearers described above, the problems caused by the deformation thereof are more prominent.

The present invention is made in views of the above-described problems, and the purpose thereof is to provide a novel image forming apparatus capable of suppressing filming that generally occurs in a longitudinal end of a latent image bearer even if it is composed of a latent image bearer easily deforming more than the conventional latent image bearer. Herein below, various embodiments of an image forming apparatus to which the present invention is applicable are described, in particular in FIG. 2, a copy machine 100 acting as an image forming apparatus according to one embodiment of the present invention is described. The copy machine 100 is a tandem type color image forming apparatus, in which multiple image forming units 10 (Y, M, C, and BK) are juxtaposed while facing an intermediate transfer belt 17 as multiple image forming units.

In the drawing, reference numeral 1 indicates a main unit of a color copy machine acting as the image forming apparatus.

Reference numeral 4 indicates an original document reading unit that reads image information of an original document. Reference numeral 3 indicates an original document conveying unit that conveys the original document to an original document reading unit 4. Reference numeral 6 indicates a writing section (an exposing unit) that emits a laser light beam based on input image data. Reference numeral 7 indicates a sheet feeding unit that stores and feeds transfer sheets P as recording media therefrom. Reference numeral 10 (Y, M, C, and BK) indicates each of the image forming units of respective colors (e.g., yellow, magenta, cyan, and black). Reference numeral 17 indicates an intermediate transfer belt (i.e., an intermediate transfer member) to which more than one color toner image is repeatedly transferred. Reference numeral 18 indicates a secondary transfer roller that secondarily transfers a toner image borne on the intermediate transfer belt 17 onto a transfer sheet P. Reference numeral 20 indicates a fixing unit that fixes an unfixed image on the transfer sheet P. Reference numeral 28 indicates each of toner containers that replenish respective color toner particles to developing units of the four image forming units 10 (Y, M, C, and BK).

FIG. 1 is a diagram schematically illustrating typical one of four image forming units 10 (Y, M, C, and BK). Since these four image forming units 10 (Y, M, C, and BK) have the similar configuration with each other except for color of toner, suffixes (Y, M, C, and BK) indicating respective toner colors are sometimes omitted. As shown in FIG. 1, in each of these four image forming units 10, a drum-shaped photoconductive drum 11 as an image bearer, an electric charging unit 12, a developing unit 13 (a developing station), and a photoconductive drum cleaning unit 15 (a cleaning station) are integrated to constitute a process cartridge. The four image forming units 10 (Y, M, C, and BK) are freely detachably attachable from and to a body of the copy machine 100 as the process cartridges and are replaced with brand new image forming units 10 (Y, M, C, and BK) at the respective ends of lives of those. On the respective photoconductive drums 11 of the image forming units 10 (Y, M, C, and BK), toner images of four colors (yellow, magenta, cyan and black) are formed.

Herein below, a general operation of color image formation executed in the copy machine 100 is described. First, the original document is conveyed from an original document table by a conveying roller disposed in an original document conveying unit 3 and is placed on a contact glass disposed in the original document reading unit 4. Subsequently, in the original document reading unit 4, the image information of the original document placed on the contact glass is optically read. More specifically, in the original document reading unit 4, a light beam originated from an illumination lamp is irradiated to scan an image of the original document placed on the contact glass. Subsequently, a light beam reflected by the original document forms an image on a color sensor after passing through a mirror group and lenses.

Color image information of the original document is then converted into electrical signals after read by the color sensor per color separation light of RGB (red, green, and blue). Further, an image processing unit, not shown, executes a color conversion process, a color correction process, and a space frequency correction process or the like based on RGB color separated image signals, and thereby obtaining color image information of yellow, magenta, cyan, and black.

Image information of each color of yellow, magenta, cyan, and black is sent to a writing unit 6. Subsequently, the writing unit 6 irradiates a laser light beam (i.e., an exposure light beam) toward photoconductive drums 11 of corresponding image forming units 10 (Y, M, C, and BK) based on the color image information, respectively.

Figure 2:
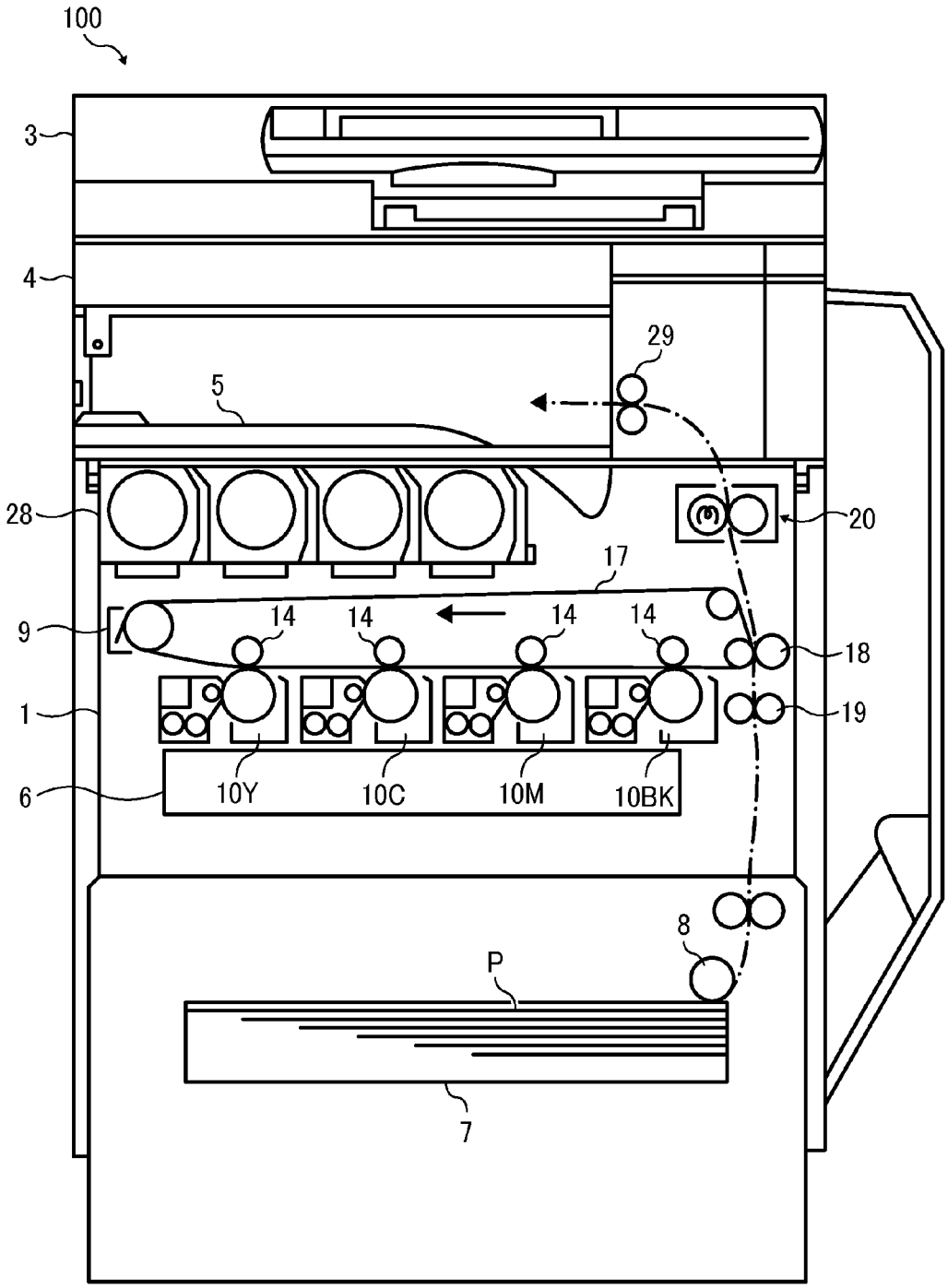
FIG. 2 is a diagram schematic illustrating an exemplary copy machine according to one embodiment of the present invention.

On the other hand, the four photoconductive drums 11, respectively rotate clockwise as shown in FIGS. 1 and 2. Thus, a surface of each of the photoconductive drums 11 is initially charged uniformly when it is opposed to an electric charging roller 12*a* of the electric charging unit 12 (i.e., in an electric charging process). The electric charging roller 12*a* contacts the surface of the photoconductive drum 11 with pressure and is accordingly driven to rotate as the photoconductive drum 11 rotates. When an image is formed, a given bias is applied to the electric charging roller 12*a* from a high-voltage power source, not shown, to electrically charge the surface of the photoconductive drum 11. Thus, an electrostatic potential is generated on each of the photoconductive drums 11. After that, surfaces of the photoconductive drums 11 charged in this way reach respective laser beam irradiated positions.

In the writing unit 6, multiple laser light beams of respective colors are emitted from light sources in accordance with image signal. Although it is omitted in the drawing, but each of the laser light beam penetrates the multiple lenses after entering and reflected by a polygon mirror. After penetrating the multiple lenses, the laser light beams of yellow, magenta, cyan, and black color components go through separate optical paths (in an exposure process), respectively.

A laser light beam of the yellow component is irradiated to a surface of the photoconductive drum 11 in the yellow image forming unit 10Y as firstly located from the left side in FIG. 2. At this moment, the yellow component laser light beam scans the photoconductive drum 11 in a rotation axial direction (i.e., a main scanning direction) when reflected and diffused by a polygon mirror, not shown, rotating at high speed. Hence, an electrostatic latent image corresponding to the yellow component is formed on the photoconductive drum 11 after it is charged by the electric charging roller 12*a*.

Similarly, the laser light beam of the cyan component is irradiated onto a surface of the photoconductive drum 11 of the cyan image forming unit 10C secondly located from the left side in FIG. 2, so that a cyan component electrostatic latent image is formed thereon. Also, the laser light beam of the magenta component is similarly irradiated onto a surface of the photoconductive drum 11 of the magenta image forming unit 10M thirdly located from the left side in FIG. 2, so that a magenta component electrostatic latent image is formed thereon. Also, the laser light beam of the black component is similarly irradiated onto a surface of the photoconductive drum 11 of the black image forming unit 10BK fourthly located from the left side in FIG. 2 (i.e., the most downstream in a running direction of the intermediate transfer belt 17), so that a black component electrostatic latent image is formed thereon.

The surfaces of the photoconductive drums 11 bearing the color electrostatic latent images then reach positions opposed to respective developing units 13 (see FIG. 1). Subsequently, respective color toner particles are supplied from the developing units 13 onto the photoconductive drums 11 to develop the latent images borne on the photoconductive drums 11 (i.e., in developing processes), respectively. The surfaces of the photoconductive drums 11 completing the developing processes are respectively reach positions opposed to the intermediate transfer belt 17. Here, in the respective opposed positions, primary transfer rollers 14 are installed to engage with an inner circumferential surface of the intermediate transfer belt 17. Subsequently, the toner images of respective colors formed on the photoconductive drums 11 are transferred sequentially onto the intermediate transfer belt 17 at primary transfer positions opposed to the primary transfer rollers 14 (i.e., in primary transfer processes).

After the primary transfer processes, the respective surfaces of the photoconductive drum 11 reach positions opposed to photoconductive drum cleaning units 15 accommodating cleaning blades 15*a* as shown in FIG. 1. Subsequently, toner particles not transferred and remaining on the photoconductive drums 11 are collected by photoconductive drum cleaning units 15 (i.e., in cleaning processes). Then, the surfaces of the photoconductive drums 11 pass through locations opposed to charge removing units, not shown, and thereby each completing a series of image forming processes executed on the respective photoconductive drums 11.

On the other hand, the surface of the intermediate transfer belt 17 bearing the respective color images repeatedly transferred and superimposed thereon as a full-color image runs in a direction indicated by arrow in the drawing and reaches a position opposed to a secondary transfer roller 18. Then, at the position opposed to the secondary transfer roller 18, the full-color image borne on the intermediate transfer belt 17 is secondarily transferred onto a transfer sheet P (i.e., in a secondary transfer process). Subsequently, the surface of the intermediate transfer belt 17 reaches a position opposed to an intermediate transfer belt cleaning unit 9. Then, toner untransferred and remaining on the intermediate transfer belt 17 is collected by the intermediate transfer belt cleaning unit 9, thereby completing a series of transfer processes on the intermediate transfer belt 17.

Here, the transfer sheet P located at the secondary transfer roller 18 is previously conveyed from the sheet feeding unit 7 via a conveyance guide and a pair of registration rollers 19 or the like as well. More specifically, the transfer sheet P is fed by a sheet feeding roller 8 from the sheet feeding unit 7 that stores multiple transfer sheets P and is led to the pair of registration rollers 19 after passing through the conveyance guide. The transfer sheet P arrived at the pair of registration rollers 19 is conveyed toward the position opposed to the secondary transfer roller 18 at a prescribed time capable of synchronizing with a toner image borne on the intermediate transfer belt 17.

The transfer sheet P with the full-color image transferred thereon is further led to the fixing unit 20. At a nip formed in the fixing unit 20 between a fixing roller and a pressure roller provided therein, the color image is fixed onto the transfer sheet P. After completing the fixing process in this way, the transfer sheet P is discharged as an output image outside the apparatus body 1 by a pair of paper ejection rollers 29 and is stacked on a paper ejection unit 5, thereby completing a series of image forming processes.

Now, an image forming unit 10 is described more in detailer with reference to FIG. 1. As shown, in the image forming unit 10, an electric charging unit 12 that electrically charge the photoconductive drum 11, a developing unit 13 that develops an electrostatic latent image formed on the photoconductive drum 11, and a photoconductive drum cleaning unit 15 that collects untransferred toner remaining on the photoconductive drum 11 are integrated in a casing.

The photoconductive drum 11 is an organic photoconductive type having a negative chargeability and is compose of a drum-shaped conductive base material and a photoconductive layer overlying thereon or the like. Although not illustrated in the drawing, on a conductive base material acting as a base material layer of a photoconductive drum 11, an under coating layer as an insulating layer, an electric charge generation layer as a photoconductive layer, an electric charge transporting layer, and a protective layer (i.e., a surface layer) are sequentially stacked in this order. As the conductive base material (i.e., the base material layer) of the photoconductive drum 11, conductive materials having a volume resistance of about $1.0\times10^{10}$ Ω·cm or less may be used.

As shown, the electric charging unit 12 is configured by an electric charging roller 12*a* and an electric charging member cleaning roller 12*b* or the like. The electric charging roller 12*a* is composed of a conductive core bar covered with an elastic layer having a medium resistance. The electric charging member cleaning roller 12*b* is provided to remove stains on the electric charging roller 12*a* and is disposed contacting the electric charging roller 12*a*. In such an electric charging unit 12, a given voltage is applied to the electric charging roller 12*a* from a power supply, not shown, to enable the electric charging roller 12*a* to uniformly charge a surface of the photoconductive drum 11 opposed thereto.

The developing unit 13 is primarily composed of a developing roller 13*a*, a first conveyor screw 13*b*1, a second conveyor screw 13*b*2, and a so called doctor blade 13*c*. The developing roller 13*a* is located at a position opposed to the photoconductive drum 11. The first conveyor screw 13*b*1 is placed at a position opposed to the developing roller 13*a*. Also, the second conveyor screw 13*b*2 is opposed to the first conveyor screw 13*b*1 via a partition member. The doctor blade 13*c* is positioned facing the developing roller 13*a* between the first conveyor screw 13*b*1 and the photoconductive drum 11.

The developing roller 13*a* is configured by a magnet internally secured thereto to establish multiple magnetic poles on a circumferential surface thereof and a sleeve rotating around the magnet. Thus, since the multiple-magnetic poles are formed by the magnet on the developing roller 13*a* (i.e., the sleeve), developer is borne on the developing roller 13*a*. Here, in the developing unit 13, two-component developer mainly composed of carrier and toner is contained, for example.

In the photoconductive drum cleaning unit 15, a cleaning blade unit 15*a*, a conveying coil 15*b*, and a casing 15*c* or the like are installed. The cleaning blade unit 15*a* contacts the photoconductive drum 11 as a cleaning unit. The conveying coil 15*b* conveys toner (i.e., untransferred toner) collected as waste toner by the photoconductive drum cleaning unit 15 in a longitudinal direction toward a waste toner collecting container (not shown) disposed outside the photoconductive drum cleaning unit 15. The casing 15*c* acts as a member to cover the photoconductive drum cleaning unit 15 thereabout.

The cleaning blade unit 15*a* is mainly configured by a blade-shaped plate like member 15*a*1 (i.e., a blade as a main body) made of rubber such as urethane rubber, etc., and a sheet like holder unit 15*a*2 (i.e., a blade holder) made of metal to hold the blade-shaped member 15*al*. The blade-shaped member 15*a*1 of the cleaning blade unit 15*a* contacts a surface of the photoconductive drum 11 at a given angle with a prescribed amount of pressure. Hence, attached substances such as untransferred toner particles, etc., adhering to the photoconductive drum is mechanically scraped off by the cleaning blade unit 15*a* and is collected within the photoconductive drum cleaning unit 15. As the attached substances adhering to the photoconductive drum 11, sheet dust generated by the transfer sheet P (i.e., a paper sheet), discharge products generated when the electric charging roller 12*a* provides discharge to the photoconductive drum 11, and additives added to toner, etc., are exemplified beside the untransferred toner. However, the photoconductive drum cleaning unit 15 is described later in more detail.

Now, with reference to FIG. 1, the earlier described image forming processes is described in more detail. The developing roller 13*a* rotates in a direction indicated by arrow in FIG. 1

(i.e., counter clockwise). Developer stored in the developing unit 13 is conveyed in a longitudinal direction (i.e., in a direction perpendicular to a plane of FIG. 1) and circulates within the developing unit 13 as the first and second conveyor screws 13*b*1 and 13*b*2 rotate sandwiching the intervening partition therebetween. At this moment, fresh toner is newly supplied by a toner supplying system, not shown, from a toner container 28, so that the above-described developer in the developing unit 13 is mixed and stirred together with the fresh toner during its conveyance.

The developer is friction charged when stirred and mixed, so that toner adsorbed to a carrier is borne on the developing roller 13*a* together with the carrier. Subsequently, the developer borne on the developing roller 13*a* reaches a regulatory position in which the doctor blade 13*c* is opposed to the developing roller 13*a*. Subsequently, after an amount of developer borne on the developing roller 13*a* is adjusted at the regulatory position, the developer reaches a developing region opposed to the photoconductive drum 11.

Subsequently, the toner in the developer adheres to an electrostatic latent image formed on a surface of the photoconductive drum 11 in the developing region. Specifically, a toner image is formed on the photoconductive drum 11 under influence of an electric field generated by a difference in electrical potential between a latent image potential of an image section, onto which a laser beam L is irradiated (i.e., an exposed potential), and a developing bias (i.e., a developing potential) applied to the developing roller 13*a*.

Most of the toner adhering to the photoconductive drum 11 is transferred onto the intermediate transfer belt 17. Subsequently, the photoconductive drum 11 is cleaned by the cleaning blade unit 15*a* by removing untransferred toner remaining on the photoconductive drum 11 therefrom. The toner is collected and stored in the photoconductive drum cleaning unit 15.

Here, although an illustration of it is omitted, the toner supplying unit provided in the apparatus body 1 of the copy machine 100 is configured by bottle-shaped freely replaceable toner containers 28 and toner hoppers that hold and rotate the toner containers 28 to supply brand new toner to the respective developing units 13. Specifically, the brand new toner (one of yellow, magenta, cyan, and black) is accommodated in each of the toner containers 28. Further, on a bottle-shaped inner circumferential surface of the toner container 28, a spiral protrusion is formed.

The brand new toner stored in the toner container 28 is supplied accordingly to the developing unit 13 through a toner supply port as toner (i.e., existing toner) in the developing unit 13 is consumed. Although it is not shown in the drawing, consumption of toner in the developing unit 13 is either directly or indirectly detected by a reflective photosensor opposed to the photoconductive drum 11 and a magnetic sensor installed below the second conveyor screw 13*b*2 of the developing unit 13.

Herein below, the photoconductive drum cleaning unit 15 provided in the copy machine 100 is described in more detail with reference to FIG. 1 and applicable drawings according to one embodiment of the present invention. As shown in FIG. 1, in the photoconductive drum cleaning unit 15, the cleaning blade unit 15*a* is installed. The cleaning blade unit 15*a* is mainly configured by the blade-shaped member 15*a*1 (i.e., the blade as the main body) made of rubber and the holder unit 15*a*2 (i.e., the blade holder) that holds the blade-shaped member 15*al*. Here, a longitudinally extending tip of the blade-shaped member 15*a*1 engages with the photoconductive drum 11 (i.e., in a direction perpendicular to a plane of FIG. 1). At the same time, a root of the blade-shaped member 15*a*1 is secured to and held by the holder unit 15*a*2.

Figure 3:
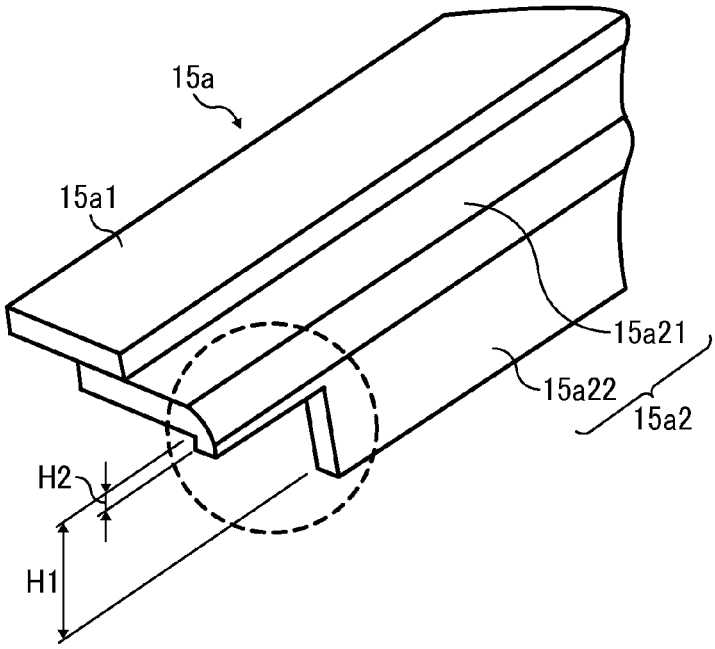
FIG. 3 is an enlarged perspective view illustrating an exemplary section near an end of a cleaning blade in the longitudinal direction thereof included in a photoconductive drum cleaning unit according to one embodiment of the present invention.

Now, a first practical example of the photoconductive drum cleaning unit 15 is described herein below with reference to FIG. 3 and applicable drawing. FIG. 3 is an enlarged perspective view illustrating an end of the cleaning blade unit 15*a* included in the photoconductive drum cleaning unit 15 of the first practical example when taken in a longitudinal direction thereof.

As shown in FIGS. 1 and 3, the holder unit 15*a*2 has an L-shaped cross section in its short direction perpendicular to its longitudinal direction. Also, as shown in FIG. 3, a supporting section 15*a*21 (i.e., a fixed section) and a bending section 15*a*22 collectively constitute the holder unit 15*a*2. The supporting section 15*a*21 of the holder unit 15*a*2 supports the blade-shaped member 15*a*1 on its surface so that the tip of the blade-shaped member 15*a*1 can protrude toward the photoconductive drum 11.

Specifically, the blade-shaped member 15*a*1 is glued onto the surface of the supporting section 15*a*21 by using either a double-sided tape or an adhesive. The bending section 15*a*22 of the holder unit 15*a*2 is orthogonal to the supporting section 15*a*21 thereby having the above-described L-shaped cross-section together with the supporting section 15*a*21. The bending section 15*a*22 is configured to include a length H2 in a short direction at least at one of ends in its longitudinal direction, which is shorter than a length H1 in the short direction at a center in its longitudinal direction (i.e., H1>H2). In other words, the bending section 15*a*22 of the holder unit 15*a*2 has a notch at least at its one ends in its longitudinal direction (i.e., a section enclosed by a dashed line in FIG. 3).

With such a configuration, stiffness of the holder unit 15*a*2 is reduced at its one end in the longitudinal direction when compared to that at the center in the longitudinal direction. Therefore, a contact pressure of the blade-shaped member 15*a*1 contacting the photoconductive drum 11 at one end in its longitudinal direction, at which a less amount of untransferred toner enters (is inputted), becomes less than that at the center in its longitudinal direction at which a more amount of untransferred toner enters. Specifically, the holder unit 15*a*2 is configured to minimize stiffness required to hold the blade-shaped member 15*a*1 at its both ends in the longitudinal direction, at which the blade-shaped member 15*a*1 receives the less amount of untransferred toner and is easily torn off or generates vibration sound. With this, the contact pressure of the blade-shaped member 15*a*1 is reduced at its both ends.

Since it is correlated to an amount of the contact pressure, the tearing off and the vibration sound generated by the blade-shaped member 15*a*1 at the ends in the longitudinal direction can be likely definitely reduced. Furthermore, since a less amount of untransferred toner is input to (enter) at least one end of the blade-shaped member 15*a*1 in the longitudinal direction thereof, defective cleaning generally caused by decreasing in contact pressure almost never occurs.

Also, in the first practical example, to minimize the stiffness of both ends of the holder unit 15*a*2 in the longitudinal direction than that in the center thereof, the notches are formed in the bending section 15*a*22 rather than the supporting section 15*a*21. That is, the supporting section 15*a*21 does not include any notch over a surface in the longitudinal direction thereof, thereby forming a complete rectangular shape. Therefore, a wide bonding surface (a pasting margin) can be ensured uniformly on the surface of the supporting section 15*a*21 in the longitudinal direction for bonding the blade-shaped member 15*a*1. Therefore, a problem that a prescribed pasting strength is lacked between the blade-shaped member 15*a*1 and the supporting section 15*a*21, and accordingly the blade-shaped member 15*a*1 peels off from the supporting section 15*a*21 can be likely prevented.

Figure 4:
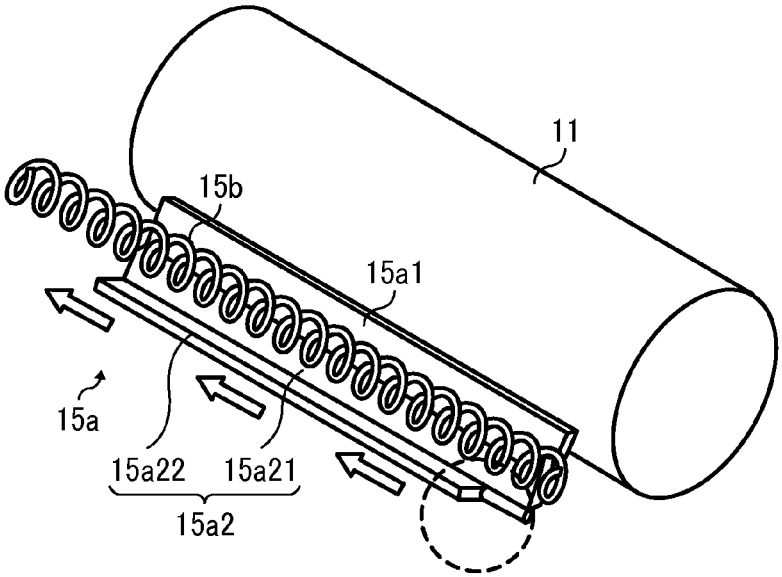
FIG. 4 is a perspective view illustrating a positional relation between a cleaning blade of a photoconductive drum cleaning unit, a conveying coils, and a photoconductive drum according to one embodiment of the present invention.

FIG. 4 illustrates a positional relation between the cleaning blade unit 15*a* of the photoconductive drum cleaning unit 15, a conveying coil 15*b*, and a photoconductive drum 11 provided in the first practical example. As shown there, in the first practical example, out of both ends of the bending section 15*a*22 in the longitudinal direction in the holder unit 15*a*2, a notch is provided only at one end of the bending section 15*a*22 in the longitudinal direction thereof to minimize a length H2 in its short direction. Specifically, the length of one end of the bending section 15*a*22 of the holder unit 15*a*2 in the short direction corresponding to an upstream of a conveying direction (i.e., in a direction shown by white arrow in FIG. 4), in which toner (i.e., untransferred toner) is conveyed by the conveying coil 15*b*, is less than the length in the short direction of the rest of the bending section 15*a*22 in the longitudinal direction. That is, the notch (a section enclosed by a dashed line circle in FIG. 4) is formed in the bending section 15*a*22 of the holder unit 15*a*2 at the one end thereof in the longitudinal direction corresponding to the upstream in the conveyance direction. On the other hand, a notch is not formed, however, at another end of the bending section 15*a*22 in the longitudinal direction corresponding to a downstream in the conveying direction of the toner.

At a position opposed to the upstream in the conveyance direction of the conveying coil 15*b* (i.e., at the upstream end in the longitudinal direction), even if it has a small amount, but the toner is removed by the blade-shaped member 15*a*1 from the photoconductive drum 11 and is instantly conveyed downstream by the conveying coil 15*b*. Because of this, only few amounts of toner intervene between a tip of the blade-shaped member 15*a*1 (and the photoconductive drum 11 at the upstream end). By contrast, at a position opposed to the downstream in the conveyance direction of the conveying coil 15*b* (i.e., a longitudinal downstream end), although a small amount of toner is again directly scraped off by the blade-shaped member 15*a*1 from the photoconductive drum 11, a relatively large amount of toner is conveyed from the upstream by the blade-shaped member and remains at the tip of the blade-shaped member 15*a*1 there, and accordingly some of the toner easily intervenes between the tip thereof (and the photoconductive drum 11 at the longitudinal downstream end). Therefore, at the position opposed to the downstream in the conveyance direction of the conveying coil 15*b* (i.e., the longitudinal downstream end), the tearing off and the vibration sound hardly occurs even when a notch is not formed in the bending section 15*a*22.

Here, a photoconductive drum cleaning unit excluding a conveyor unit, such as a conveying coil 15*b*, etc., may be possibly employed. Otherwise, a photoconductive drum cleaning unit with a conveyor unit, such as a conveying coil 15*b*, etc., far distanced below from the blade-shaped member 15*a*1 may be possibly employed as well. In such photoconductive drum cleaning units, however, the toner conveyed by the above-described conveying coil 15*b* cannot be expected to intervene at the tip of the blade-shaped member 15*a*1 (in the downstream). Because of this, a pair of notches may be preferably formed at both ends of the bending section 15*a*22 of the holder unit 15*a*2 in its longitudinal direction.

Figure 5:
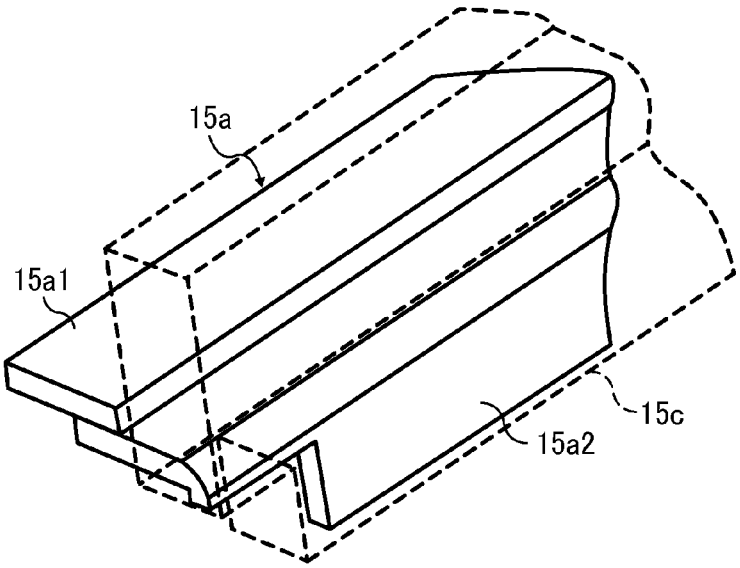
FIG. 5 is an enlarged perspective view illustrating an exemplary casing of the photoconductive drum cleaning unit identified by a dashed line added to the photoconductive drum cleaning unit of FIG. 3 according to one embodiment of the present invention.

FIG. 5 is a perspective view illustrating the cleaning blade unit 15*a* of FIG. 3 and a casing 15*c* that almost covers the photoconductive drum cleaning unit 15 as shown by a dashed lines. As shown there, the casing 15*c* (e.g., an apparatus cover) is formed to almost cover the photoconductive drum cleaning unit 15 and the cleaning blade 15 along the shape of the holder unit 15*a*2. Specifically, a recess is formed in the casing 15*c* to match with a shape of the notch formed in the bending section 15*a*22 of the holder unit 15*a*2. With the above-described configuration, the overall dimension of the photoconductive drum cleaning unit 15 can be reduced to the necessity minimum while reducing interference with the main body of the copy machine 100 or the image forming unit 10. Further, a space-saved recess is effectively used in either the image forming unit 10 or the main body of the copy machine 100.

Figure 6:
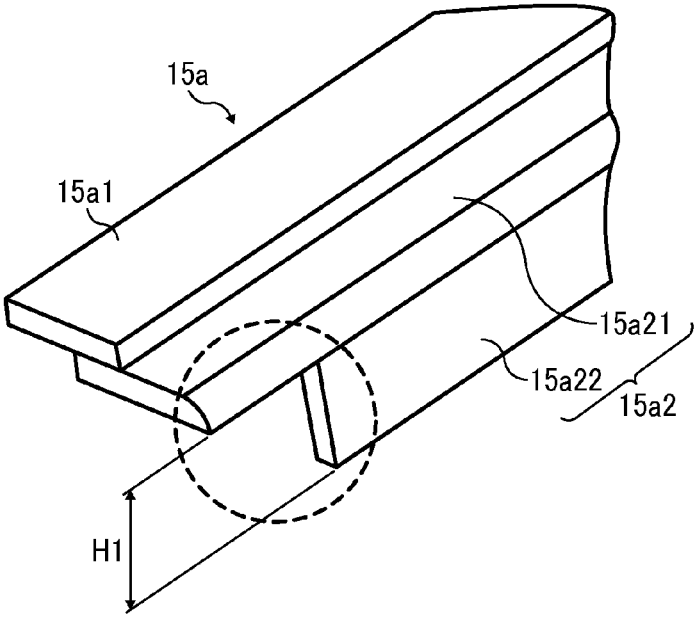
FIG. 6 is an enlarged perspective view illustrating a section near an end of the cleaning blade in a longitudinal direction thereof in which a bending portion of a holder has no length (i.e., zero) in a short direction at a longitudinal end thereof according to one embodiment of the present invention.

FIG. 6 is an enlarged perspective view illustrating an exemplary section near the end of the cleaning blade unit 15*a* taken in the longitudinal direction thereof when a length H2 in a short direction of one end of a bending section 15*a*22 of the holder unit 15*a*2 in the longitudinal direction is zero (mm). As described earlier in the first practical example with reference to FIG. 3, the length H2 in the short direction of one end of the bending section 15*a*22 in the longitudinal direction of the holder unit 15*a*2 is set to a few millimeters. By contrast, as shown in FIG. 6, the length H2 in the short direction of one end of the bending section 15*a*22 in the longitudinal direction is set to 0 mm. Specifically, the bending section 15*a*22 can be substantially omitted at one end of the holder unit 15*a*2 in the longitudinal direction. Even in such a situation, the similar advantage can be obtained as in the above-described configuration shown in FIG. 3.

As shown in FIGS. 3 to 6, in the cleaning blade unit 15*a* of the first practical example, the bending section 15*a*22 of the holder unit 15*a*2 has a shorter length H2 in the short direction at one longitudinal end than a length H1 in the short direction of the center thereof in the longitudinal direction. With this, tearing off and the vibration noise of the blade-shaped member 15*a*1 (i.e., the cleaning blade unit 15*a*) can be reduced while suppressing a side effect such as defective cleaning, etc.

Figure 7:
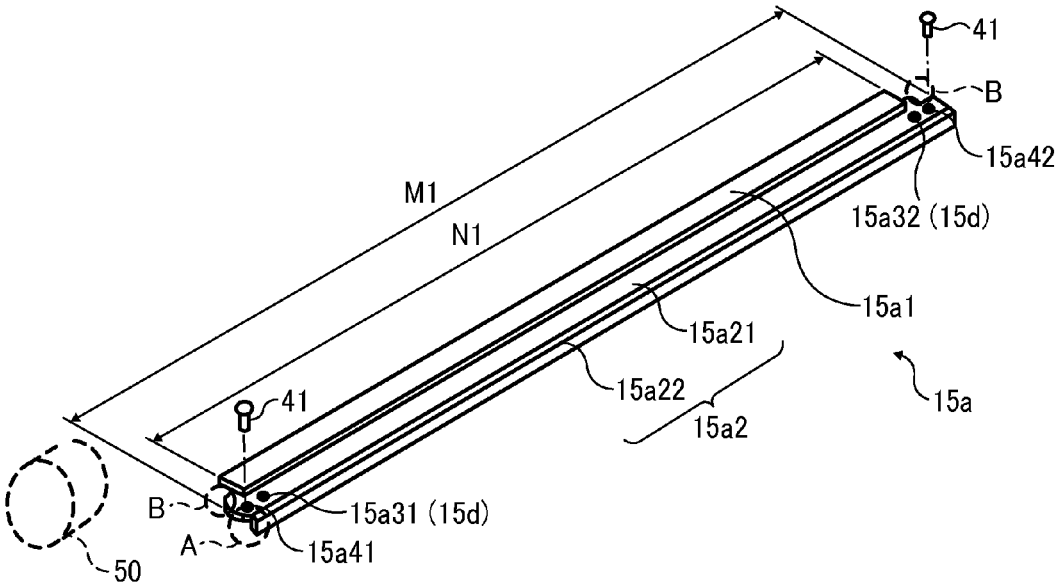
FIG. 7 is an enlarged perspective view illustrating an exemplary cleaning blade employed in a photoconductive drum cleaning unit according to a second embodiment of the present invention.
Figure 8:
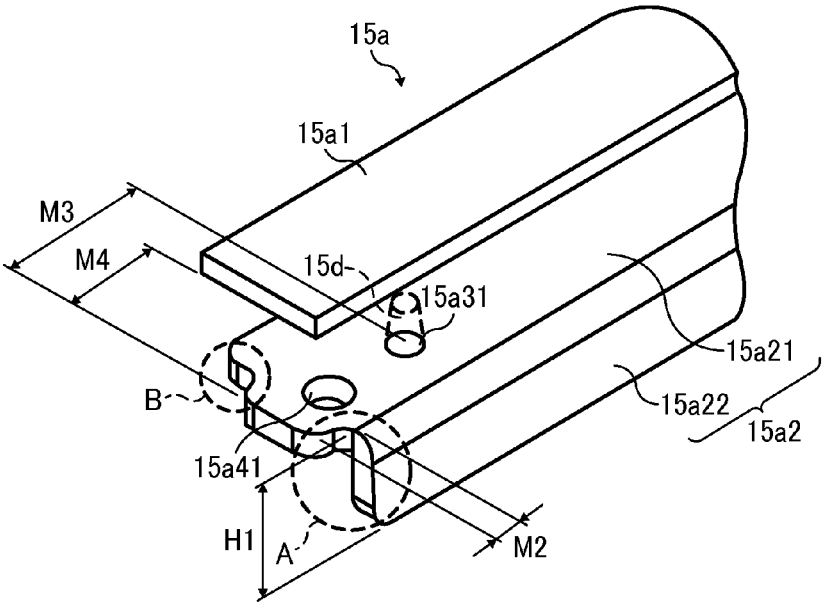
FIG. 8 is also an enlarged perspective view partially illustrating one end of the cleaning blade of FIG. 7 in its longitudinal direction according to a second embodiment of the present invention.

Herein below, a photoconductive drum cleaning unit 15 of a second embodiment (herein after reference to as a second practical example) is described with reference to FIG. 7 and applicable drawing. FIG. 7 is an enlarged perspective view illustrating a second practical example of a cleaning blade unit 15*a* provided in the photoconductive drum cleaning unit 15. FIG. 8 is a partially enlarged perspective view illustrating one end of the cleaning blade unit 15*a* shown in FIG. 7 taken in the longitudinal direction thereof. Also, FIGS. 9A to 9D are diagrams collectively illustrating a method of manufacturing the cleaning blade unit 15*a* of the second practical example. FIGS. 10A to 10E are diagrams collectively illustrating a different manufacturing method of manufacturing the cleaning blade unit 15*a*. However, in FIGS. 9A to 9D and 10A to 10E, illustration of detailed portions of the cleaning blade unit 15*a* are simplified as shown.

The cleaning blade unit 15*a* of the second practical example is different from the cleaning blade unit 15*a* of the above-described first practical example, mainly because a blade-shaped member 15*a*1 is not disposed over the supporting section 15*a*21 in the longitudinal direction thereof in the second practical example. That is, in the first practical example, the blade-shaped member 15*a*1 is disposed over the supporting section 15*a*21 in the longitudinal direction thereof in the cleaning blade unit 15*a*.

In any way, in the photoconductive drum cleaning unit 15 of the second practical example, as in the photoconductive drum cleaning unit 15 of the first practical example, a cleaning blade unit 15*a* engaging with the photoconductive drum 11 is installed. The cleaning blade unit 15*a* mainly includes a blade-shaped plate like member 15*a*1 (i.e., a blade as a main body) made of rubber, such as urethane rubber, etc., and a holder unit 15*a*2 (i.e., a blade holder) composed of a metal plate to hold the plate like blade-shaped member 15*a*1. Further, in the cleaning blade unit 15*a* of the second practical example, a notch (a section surrounded by a dashed line A in FIG. 8) is also formed at an end of a bending section 15*a*22 of the holder unit 15*a*2 in its longitudinal direction.

The holder unit 15*a*2 of the cleaning blade unit 15*a* of the second practical example includes a main reference section 15*a*31 (a hole) and a sub-reference section 15*a*32 (i.e., an oblong hole) to determine a position of the cleaning blade unit 15*a* at the photoconductive drum cleaning unit 15. The main and sub-reference sections 15*a*31 and 15*a*32 are separately formed at both ends of the holder unit 15*a*2 in its longitudinal direction, respectively. More specifically, at one end of a supporting section 15*a*21 of the holder unit 15*a*2 in a longitudinal direction thereof, the main reference section 15*a*31 (the hole) is formed to position it at a casing, not shown, of the photoconductive drum cleaning unit 15. At the other one end of a supporting section 15*a*21 of the holder unit 15*a*2 in the longitudinal direction thereof, the sub-reference section 15*a*32 (the oblong hole) is formed to position it at a casing, not shown, of the photoconductive drum cleaning unit 15 as well.

With these main and sub-reference sections 15*a*31 (the hole) and 15*a*32 (the oblong hole), a pair of bosses, not shown, rising up from the casing of the photoconductive drum cleaning unit 15 engage, respectively. With these engagements, the cleaning blade unit 15*a* (i.e., the holder unit 15*a*2) is positioned at the photoconductive drum cleaning unit 15. In the second practical example, the hole of the main reference section 15*a*31 has a diameter of about 3 [mm] Whereas, the oblong hole of the sub-reference section 15*a*32 has a diameter of about 4 mm and a length of about 7 [mm] (i.e., 4 mm×7 mm).

In the holder unit 15*a*2, a screw fastening hole 15*a*41 and a screw fastening oblong hole 15*a*42 are separately formed at respective ends of the holder unit 15*a*2 in its longitudinal direction to secure the cleaning blade unit 15*a* at the photoconductive drum cleaning unit 15. More specifically, at one end of the supporting section 15*a*21 included in the holder unit 15*a*2 in its longitudinal direction, the screw fastening hole 15*a*41 is formed to fasten (the cleaning blade unit 15*a*) to the casing of the photoconductive drum cleaning unit 15 with a screw. At the other one end of the supporting section 15*a*21 included in the holder unit 15*a*2 in its longitudinal direction, the screw fastening oblong hole 15*a*42 is formed to fasten (the cleaning blade unit 15*a*) to the casing of the photoconductive drum cleaning unit 15 with a screw.

Hence, when the pair of bosses 15*d* is engaged with the main and sub-reference sections 15*a*31 (the hole) and 15*a*32 (the oblong hole), respectively, to execute the above-described positioning, a pair of screws (e.g., M4 screws (ISO standard meter screws each having a diameter of 4 mm)) 41 is mated with a pair of female screws formed in the casing via the screw fastening hole 15*a*41 and oblong hole 15*a*42, respectively. This allows the cleaning blade unit 15*a* (i.e., the holder unit 15*a*2) to be fixed (i.e., fastened with the screws) to the photoconductive drum cleaning unit 15. In the second practical example, the screw fastening hole 15*a*41 has a diameter of about 4 [mm] Whereas, the screw fastening oblong hole 15*a*42 has a diameter of about 5 [mm] and a length of about 9 [mm] Also, as each of the screws 41, the M4 screw is used.

In the second practical example, a length of the short direction of one end of the bending section 15*a*22 of the holder unit 15*a*2 in the longitudinal direction thereof, at which the main reference section 15*a*31 is provided, is shorter than a length H1 in the short direction of the rest of the bending section 15*a*22 of the holder unit 15*a*2 in the longitudinal direction. Specifically, similar to what specifically described with reference to FIG. 6, about zero [mm] is set to the length in the short direction of one end of the bending section 15*a*22 of the holder unit 15*a*2 in the longitudinal direction thereof. Specifically, at one end of the bending section 15*a*22 of the holder unit 15*a*2 in its longitudinal direction, at which the main reference section 15*a*31 (the hole) is provided, a notch (a portion circled by a dashed line A in FIGS. 7 and 8) is formed. By contrast, at another end of the bending section 15*a*22 of the holder unit 15*a*2 in its longitudinal direction, at which the sub-reference section 15*a*32 (the oblong hole) is provided, a notch is not formed.

At the position (i.e., a longitudinal ends) at which the main reference section 15*a*31 is provided, the holder unit 15*a*2 is more firmly fixed (positioned) at the casing of the photoconductive drum cleaning unit 15 than at the position at which the sub-reference section 15*a*32 is provided. Because of this, since it is more difficult to let vibration escape for a side of the holder unit 15*a*2 in which the main reference section 15*a*31 is provided (than the other side thereof) when receiving the same shock, the vibration is more easily communicated from the side of the holder unit 15*a*2 to the blade-shaped member 15*al*, thereby frequently likely tearing it off and generating vibration sound in the blade-shaped member 15*al*. Thus, in the second practical example, a notch A is provided only at one of the longitudinal ends of the bending section 15*a*22, in the side in which the main reference section 15*a*31 is provided thereby easily tearing it off and generate vibration sound of the blade-shaped member 15*al*. With this, by reducing stiffness at the position at which the notch A is provided, vibration can easily escape therefrom even when the shock is applied to the holder unit 15*a*2.

Further, in the second practical example, the bending section 15*a*22 of the holder unit 15*a*2 is formed to have a shorter length in the short direction at its longitudinal end out of both longitudinal ends, at which a driving unit 50 (i.e., a driving motor) for driving the photoconductive drum 11 is installed. More specifically, the bending section 15*a*22 of the holder unit 15*a*2 is formed to have a shorter length in the short direction at its one of longitudinal ends, at which the driving unit 50 for driving the photoconductive drum 11 is installed, than a length H1 in the short direction at the other one of longitudinal ends. Specifically, in the bending section 15*a*22 of the holder unit 15*a*2, the notch (the section circled by the dashed line A in FIGS. 7 and 8) is formed at one of the longitudinal ends, at which the driving unit 50 for driving the photoconductive drum 11 is installed. Whereas, ae notch is not formed at the other one of the longitudinal ends, at which the driving unit 50 for driving the photoconductive drum 11 is not installed.

That is, vibration of a driving unit 50 is more likely conveyed to the blade-shaped member 15*a*1 of the photoconductive drum cleaning unit 15 from a side in which driving unit 50 is installed (i.e., a driving side) than a side (i.e., a driven side), in which the driving unit 50 is not installed. For this reason, tearing off and vibration sound of the blade-shaped member 15*a*1 more likely occurs on the driving side. Accordingly, in the second practical example, the notch A is provided at only one of the longitudinal ends of the bending section 15*a*22, in which the driving unit 50 is installed and accordingly the tearing off and vibration sound of the blade-shaped member 15*a*1 easily occurs. With this, by reducing stiffness at the position at which the notch A is provided, vibration can easily escape therefrom even when the shock is applied by the driving unit thereto (the holder unit 15*a*2). Here, the driving unit 50 communicates the driving force to a driving unit (e.g., a conveying coil 15*b* or the like) provided in the photoconductive drum cleaning unit 15 via a gear train, not shown.

Hence, in the second practical example, one of the longitudinal ends, in which the main reference section 15*a*31 is provided, that in which the driving unit 50 is provided, and that corresponding to the upstream in the conveying direction for the conveying coil 15*b* in the above-described first practical example match with each other. Thus, in the second practical example, since the photoconductive drum cleaning unit 15 and the copy machine body is designed in this way, the tearing off and the vibration sound generally generated by the blade-shaped member 15*a*1 can be effectively suppressed.

As shown in FIG. 7, in the second practical example, a longitudinal length N1 of the blade-shaped member 15*a*1 of the cleaning blade unit 15*a* is about 342 [mm] Also, a longitudinal length M2 of the notch A shown in FIG. 8 is about 3 [mm] A distance M4 between the end of the holder unit 15*a*2 and the end of the blade-shaped member 15*a*1 is about 9 [mm] A distance M3 between the end of the holder unit 15*a*2 and a center of the main reference section 15*a*31 (i.e., the hole) is about 13 [mm] Also, a distance M3 between the end of the holder unit 15*a*2 and a center of the screw fastening hole 15*a*41 is about 9 [mm].

In the second practical example, the longitudinal length M2 of the notch A is smaller than the distance M4 between the end of the holder unit 15*a*2 and the end of the blade-shaped member 15*a*1 (i.e., M2<M4). Because of this, occurrence of a problem in that stiffness of the supporting section 15*a*21 (i.e., a laminating surface) supporting the blade-shaped member 15*a*1 decreases excessively can be likely suppressed. Also, the longitudinal length M2 of the notch A is smaller than the distance M3 between the end of the holder unit 15*a*2 and the center of the main reference section 15*a*31 (i.e., the hole) (i.e., M2<M3). Because of this, occurrence of a problem in that stiffness of the holder unit 15*a*2 decreases excessively and accordingly positioning accuracy of the cleaning blade unit 15*a* deteriorates can be likely suppressed.

In addition, in the second practical example, the longitudinal length M2 of the notch A is set to be about 1 [%] or less of the longitudinal length M1 (i.e., an overall length) of the holder unit 15*a*2. This suitably demonstrates an advantage such that the tearing off and the vibration sound possibly generated by the blade-shaped member 15*a*1 can be suppressed.

In the second practical example, to reduce generation of chattering sound (e.g., abnormal noise) of it, the blade-shaped member 15*a*1 of the cleaning blade unit 15*a* is made of material having a rebound elasticity of about 50 [%] or less at temperature degrees of about 23[° C.]. Actually, the blade-shaped member 15*a*1 is made of material having a rebound elasticity of about 21 [%] at the temperature degrees of about 23[° C.].

Also, the blade-shaped member 15*a*1 (of the cleaning blade unit 15*a*) engages with the photoconductive drum 11 with contact pressure (e.g. a linear load generated at the contact portion) of from about 0.10 [N/cm] to about 0.50 [N/cm]. That is, when the contact pressure is larger than about 0.50 [N/cm], chattering sound (e.g. the abnormal noise) likely occurs. By contrast, when the contact pressure is smaller than about 0.10 [N/cm], performance capable of always contacting a rugged surface of the photoconductive drum 11 tightly declines, thereby readily generating defective cleaning thereon. Thus, in the second practical example, the contact pressure of the blade-shaped member 15*a*1 is set to about 0.23 [N/cm].

Further, the blade-shaped member 15*a*1 is made of the material having a hardness (i.e., JIS-A hardness at temperature degrees of 25[° C.]) of from about 60 to about 80. That is, when the hardness is greater than 80 degrees, the blade-shaped member 15*a*1 likely partially contacts the photoconductive drum 11. By contrast, when the hardness is below 80 degrees, the blade-shaped member 15*a*1 tends to contact the photoconductive drum 11 with its body. Thus, the blade-shaped member 15*a*1 is made of materials having a hardness of about 75 degrees.

Further, in addition to the above-described notch A that prevents tearing off and generation of vibration noise of the blade-shaped member 15*a*1 as described heretofore with reference to FIGS. 7 and 8, the cleaning blade unit 15*a* of the second practical example further includes a pair of second notches (each of sections indicated by a dashed line B in the drawing) also formed in the supporting section 15*a*21 of the holder unit 15*a*2 at respective longitudinal ends thereof. These second notches B are provided in order to avoid interference with the other member (e.g. a machine frame or the like) disposed close to the cleaning blade unit 15*a*. The second notches B are designed not to affect both stiffness and cleaning performance of the cleaning blade unit 15*a* (i.e., the holder unit 15*a*2 and the blade-shaped member 15*a*1). Specifically, in the second practical example, each of the second notches B has a longitudinal length of about 3 mm, and a short side length of about 4.5 [mm].

Herein below, various exemplary methods of manufacturing the cleaning blade unit 15*a* is briefly described with reference to FIGS. 9A to 10E.

Figure 9A:
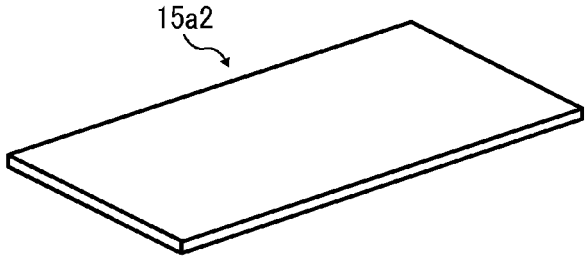
FIGS. 9A to 9D are diagrams collectively illustrating a method of manufacturing the cleaning blade of the second embodiment according to one embodiment of the present invention.
Figure 9B:
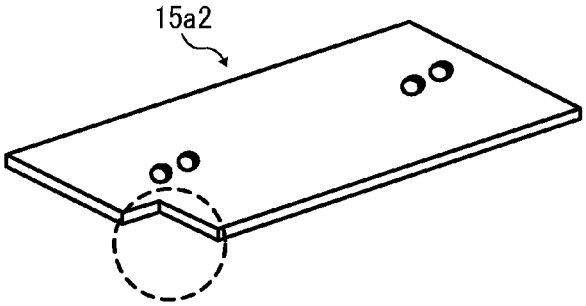
Figure 9C:
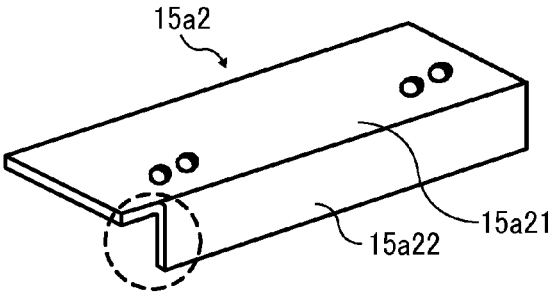
Figure 9D:
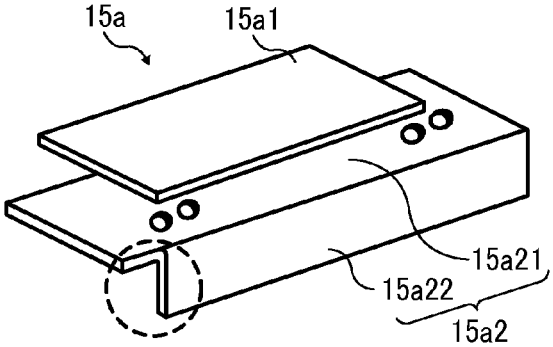

First, a flat sheet metal (ultimately serving as a holder unit 15*a*2) as shown in FIG. 9A is prepared, and a punching processing is then applied to the sheet metal as shown in FIG. 9B. At this moment, a notch A, a main reference section 15*a*31, and a sub-reference section 15*a*32 are formed on the sheet metal. Then, as shown in FIG. 9C, a bending process is applied to the sheet metal, so that an L-shaped holder unit 15*a*2 is accordingly formed. Subsequently, as shown in FIG. 9D, a blade-shaped member 15*a*1 is laminated onto a supporting section 15*a*21 of a holder unit 15*a*2, thereby eventually completing a process of manufacturing of the cleaning blade unit 15*a*. Here, in the above-described manufacturing process, the punching process described as described with reference to FIG. 9B and the bending process described as described with reference to FIG. 9C can be executed at the same time as well.

Figure 10A:
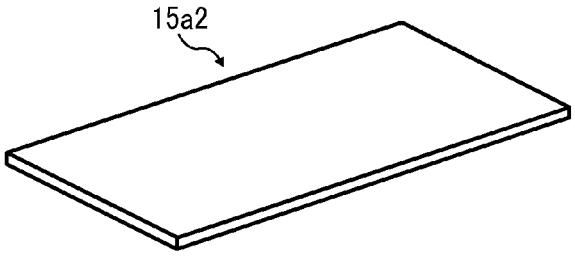
FIGS. 10A to 10E are diagrams collectively illustrating another method of manufacturing the cleaning blade of FIG. 9 according to one embodiment of the present invention.
Figure 10B:
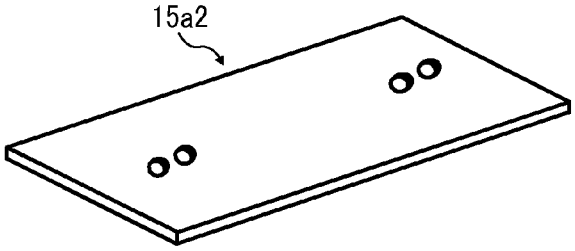
Figure 10C:
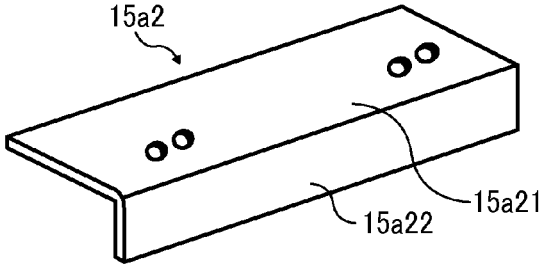

Now, a different method of manufacturing the cleaning blade unit 15*a* is described with reference to FIGS. 10A to 10E. First, a flat sheet metal (ultimately serving as a holder unit 15*a*2) as shown in FIG. 10A is prepared, and a punching processing is applied to the sheet metal as shown in FIG. 10B. However, unlike the manufacturing method as described in FIGS. 9A to 9D, a notch A is not formed at this moment by applying the punching process to the sheet metal. Then, as shown in FIG. 10C, a bending process is applied to the sheet metal, so that an L-shaped metal plate is accordingly formed.

Figure 10D:
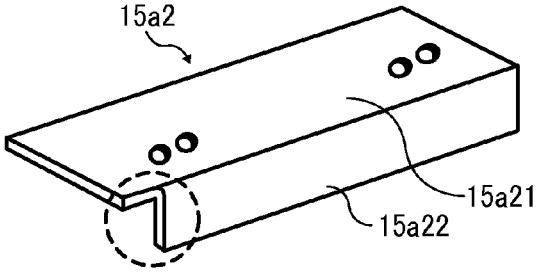
Figure 10E:
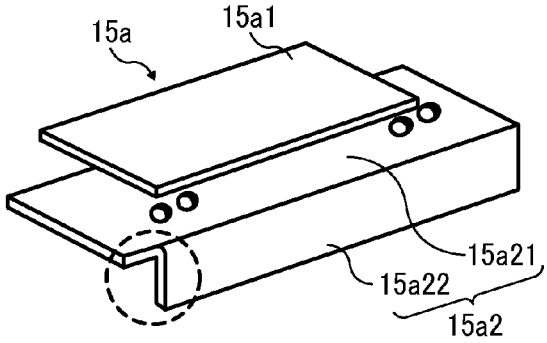

After that, as shown in FIG. 10D, a notch A is formed by applying a cutting or melting process and the like to the L-shaped sheet metal, thereby forming and completing a process of manufacturing a holder unit 15*a*2. Subsequently, as shown in FIG. 10E, onto the supporting section 15*a*21 of the holder unit 15*a*2, a blade-shaped member 15*a*1 is laminated, thereby eventually completing a process of manufacturing the cleaning blade unit 15*a*. Here, in the above-described manufacturing process, the punching process as described with reference to FIG. 10B and the bending process as described with reference to FIG. 10C can be executed at the same time.

Further, the process of forming the notch A as described with reference to FIG. 10D can be also executed after the process of laminating the blade-shaped member 15*a*1 as described with reference to FIG. 10E. This means that the notch A can be formed (in the holder unit 15*a*2) even after the cleaning blade unit 15*a* is mounted on the photoconductive drum cleaning unit 15 without the notch A of the holder unit 15*a*2 to suppress the tearing off and generation of the vibration sound of the blade-shaped member 15*a*1 later.

In the configuration of the second practical example, similar to the above-described first practical example, the length of the short direction one of longitudinal ends of the bending section 15*a*22 of the holder unit 15*a*2 is shorter than that in the short direction H1 of the center thereof in the longitudinal direction. Hence, the tearing off and the vibration noise generally generated by the blade-shaped member 15*a*1 (i.e., the cleaning blade unit 15*a*) can be reduced without causing a side effect such as defective cleaning, etc.

In a copy machine 100 with an image forming unit 10 having the above-described photoconductive drum cleaning unit 15 of one of the first and second practical examples, various parts, such as a photoconductive drum 11, an electric charging unit 12, a developing unit 13, a photoconductive drum cleaning unit 15, etc., are integrated to configure a process cartridge. With this, an image forming unit is downsized while improving maintenance performance. By contrast, however, the photoconductive drum cleaning unit 15 does not constitute a structural element of the process cartridge and can be replaceable alone to and from the copy machine 100. In such a situation, similar advantage as obtained in the above-described various embodiments can be obtained as well.

Although the present invention is applied to the photoconductive drum cleaning unit 15 with the blade-shaped member 15*a*1 made of rubber in each of the above-described various embodiments, the present invention can be also applied to the photoconductive drum cleaning unit 15 with the blade-shaped member 15*a*1 made of material other than the rubber (e.g., a plate spring member or the like) as well.

Figure 11:
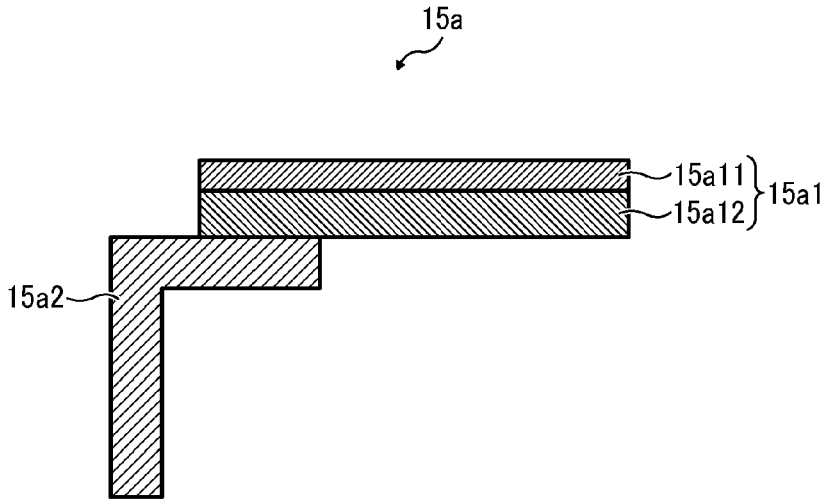
FIG. 11 is a diagram schematically illustrating the cleaning blade according to one embodiment of the present invention.

Now, the cleaning blade unit 15*a* used in the copy machine 100 according to one embodiment of the present invention is herein below described more in detail. FIG. 11 is a diagram schematically illustrating the cleaning blade unit 15*a*. As shown there, a blade-shaped member 15*a*1 acting as a blade main body of the cleaning blade unit 15*a* mainly composed of multiple layers, for example. The blade-shaped member 15*a*1 is a laminate mainly composed of two layers of an edge layer 15*a*11 directly contacting the photoconductive drum 11 and a backup layer 15*a*12 laminated on the edge layer 15*a*11 separated from the photoconductive drum 11.

The edge layer 15*a*11 is made of polyurethane having higher stiffness than the backup layer 15*a*12. Further, a 100% modulus value of the edge layer 15*a*11 is larger than that of the backup layer 15*a*12. With this, behavior of an edge of the cleaning blade unit 15*a* contacting the photoconductive drum 11 can be stabilized thereby improving cleaning performance thereof. Further, since the backup layer 15*a*12 is less intensive than the edge layer 15*a*11, loss of stiffness and drop of contact pressure due to long term usage can be prevented while obtaining a preferable cleaning performance for a long term.

As one example of a combination of the edge layer 15*a*11 and the backup layer 15*a*12, the following combination can be exemplified. Specifically, as one combination of the edge layer 15*a*11 and the backup layer 15*a*12, urethane rubber having the 100% modulus value of from about 6 [MPa] to about 7 [MPa] (at temperature degrees of 23[° C.]) and the same material having the 100% modulus value of from about 2 [MPa] to about 3 [MPa] (at temperature degrees of 23[° C.]) are used, respectively. Otherwise, from a point of rubber hardness view, urethane rubber having rubber hardness of about 80 [degrees] (JIS A) is used as the edge layer 15*a*11, and urethane rubber having rubber hardness of about 65 [degrees] (JIS A) is used as the backup layer 15*a*12, respectively. A thickness of the edge layer 15*al*1 is about 0.5 [mm], and that of the backup layer 15*a*12 is about 1.3 [mm], respectively.

Also, in this embodiment, a distance from the end of the holder unit 15*a*2 that holds the blade-shaped member 15*a*1 to the free end of the blade-shaped member 15*a*1 is about 11.5 [mm] An installation angle at a contact position made by (the blade-shaped member 15*a*1) and a tangent line of the photoconductive drum 11 is about 79.2 [degrees], and an amount of biting (of the photoconductive drum 11 into the blade-shaped member 15*a*1) is about 0.88 [mm].

Figure 12A:
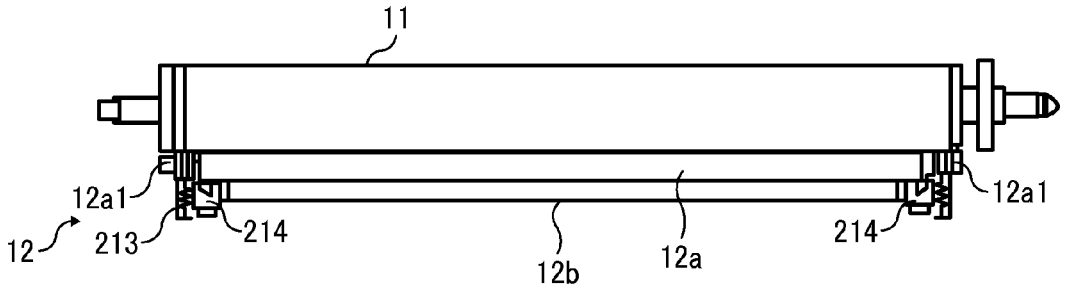
FIG. 12A is a front side view illustrating an exemplary electric charging unit 12 together with a photoconductive drum, an electric charging roller, and an electric charge cleaning roller according to one embodiment of the present invention.
Figure 12B:
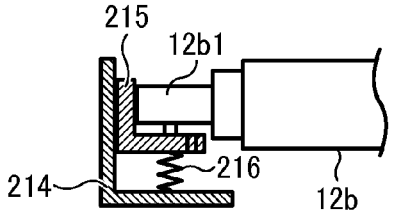
FIG. 12B is an enlarged cross-sectional view illustrating an exemplary bearing unit provided at both ends of the electric charge cleaning roller in a longitudinal direction thereof provided in the charging unit 12 according to one embodiment of the present invention.
Figure 13:
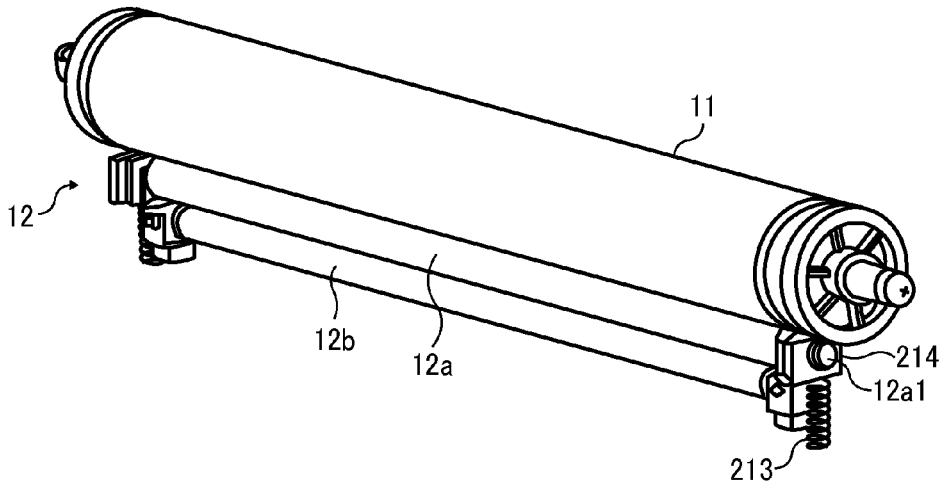
FIG. 13 is a perspective view schematically illustrating an exemplary configuration of a photoconductive drum, an electric charging roller, and an electric charge cleaning roller according to one embodiment of the present invention.
Figure 14:
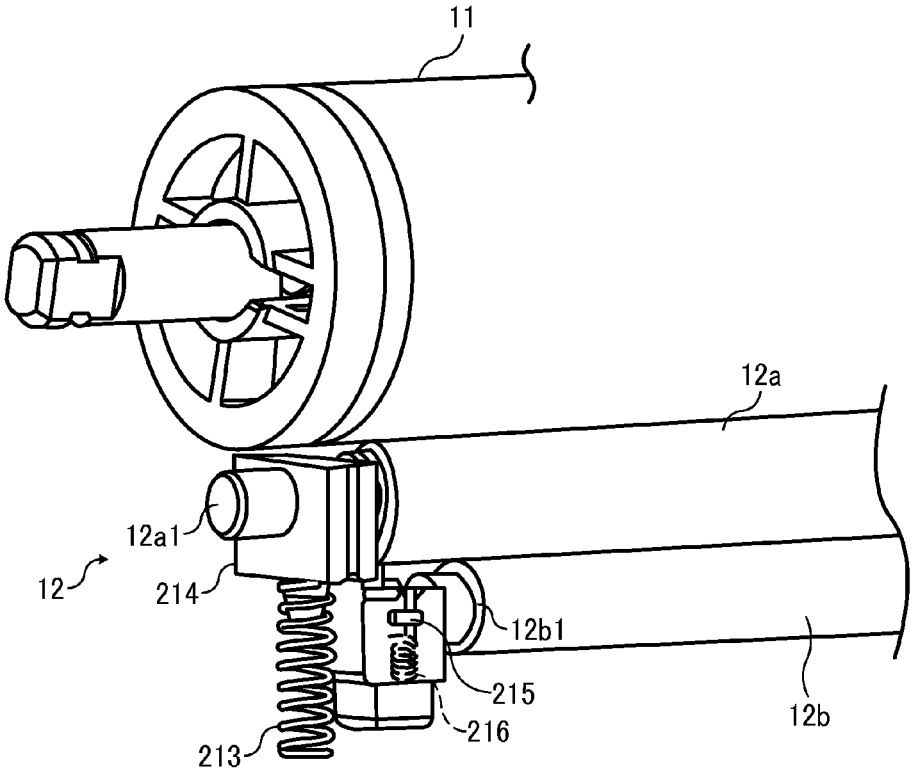
FIG. 14 is an enlarged perspective view illustrating bearing units of the photoconductive drum, the electric charging roller, and the electric charge cleaning roller according to one embodiment of the present invention.
Figure 15:
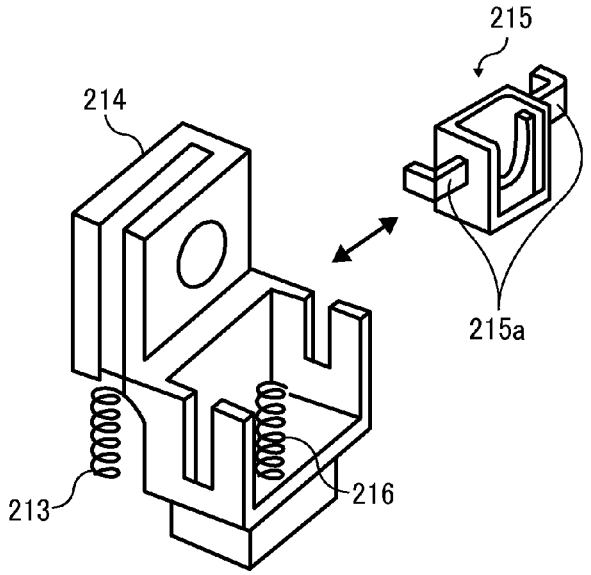
FIG. 15 is an enlarged view illustrating a bearing member for supporting the electric charging roller, a pressure spring for pressing the electric charging roller, a bearing member for supporting the electric charge cleaning roller, and a pressure spring for pressing the cleaning roller according to one embodiment of the present invention.

Now, an electric charging unit 12 provided in an image forming unit 10 of this embodiment is described with reference to FIGS. 12A to 15 and applicable drawings. FIG. 12A is a front view illustrating a photoconductive drum 11, an electric charging roller 12*a*, and an electric charging member cleaning roller 12*b* included in an electric charging unit 12. FIG. 12B is an enlarged cross-sectional view illustrating a bearing unit located at one end of the electric charging member cleaning roller 12*b* in its longitudinal direction in the electric charging unit 12. FIG. 13 is a perspective view schematically illustrating a configuration of the photoconductive drum 11, the electric charging roller 12*a*, and the electric charging member cleaning roller 12*b*. FIG. 14 is an enlarged perspective view schematically illustrating the bearing unit of the photoconductive drums 11, the electric charging roller 12*a*, and the electric charging member cleaning roller 12*b*. Also, FIG. 15 is an enlarged view illustrating an electric charging roller bearing member 214, an electric charging roller pressure spring 213, an electric charge cleaning roller bearing member 215, and an electric charge cleaning roller pressure spring 216.

In FIGS. 12A to 15, reference numerals 213, 214, 215, and 215*a* denote the electric charging roller pressure spring, the electric charging roller bearing member, the electric charge cleaning roller bearing member, and an electric charge cleaning roller bearing guide rib, respectively. Also, reference numerals 216, 12*a*, 12*a*1, 12*b*, 12*b*1, and 11 denote an electric charge cleaning roller pressure spring, an electric charging roller, an electric charging roller rotary shaft, an electric charge cleaning roller, an electric charge cleaning roller rotary shaft, and a photoconductive drum, respectively.

Below the electric charging roller 12*a*, the electric charging member cleaning roller 12*b* is provided while contacting a surface of the electric charging roller 12*a* to be driven and clean the surface. The electric charging member cleaning roller 12*b* is made of foamable polyurethane. Also, the photoconductive drum 11 is composed of an aluminum tubular member having a diameter of about 30[mm] and an organic photoconductive layer coated overlying the surface of the aluminum tubular member.

Now, a pressing mechanism for pressing the electric charging roller 12*a* and the electric charging member cleaning roller 12*b* is herein below described. The electric charging roller bearing member 214 of the electric charging roller 12*a* rotatably supports the electric charging roller rotary shaft 12*a*1. Also, the electric charging roller bearing member 214 is guided by a guide frame, not shown, and is pressed by the electric charging roller pressure spring 213 to freely slide up and down. With such an electric charging roller bearing member 214 and the electric charging roller pressure spring 213 at each of respective longitudinal ends, the electric charging roller 12*a* is pressed against the photoconductive drum 11. An amount of pressure applied by the electric charging roller 12*a* toward the photoconductive drum 11 at one side thereof is from about 5 [N] to about 6 [N].

The electric charging roller 12*a* contacts the photoconductive drum 11 with the electric charging roller rotary shaft 12*a*1 being freely rotatably supported by the electric charging roller bearing member 214. The electric charging roller 12*a* is driven and causes surface movement at the same speed as the surface of the photoconductive drum 11. An electric charge cleaning roller rotary shaft 12*b*1 is rotatably supported by an electric charge cleaning roller bearing member 215. The electric charging roller bearing member 214 vertically extends from a position supporting the electric charging roller rotary shaft 12*a*1 to hold the electric charge cleaning roller bearing member 215 as an electric charge cleaning roller bearing member holder. In other words, the electric charging roller bearing member 214 and the electric charge cleaning roller bearing holder to support the electric charge cleaning roller bearing member 215 are integral with each other.

As shown in FIG. 15, the electric charge cleaning roller bearing member 215 has a pair of electric charge cleaning roller bearing guide ribs 215*a* protruding from the electric charging roller bearing member 214 when it is nested in and held by the electric charging roller bearing member 214. Between the electric charge cleaning roller bearing member 215 and the electric charging roller bearing member 214, an electric charge cleaning roller pressure spring 216 intervenes as an elastic member. Thus, the electric charge cleaning roller bearing member 215 can vertically slide up and down from and to the electric charging roller bearing member 214. Further, since it is fixed to the electric charging roller bearing member 214, the electric charge cleaning roller pressure spring 216 presses the electric charge cleaning roller bearing member 215. With this, the electric charging member cleaning roller 12*b* supported by the electric charge cleaning roller bearing member 215 at each of respective ends there in the longitudinal direction presses against the electric charging roller 12*a*. Here, an amount of pressure applied by the electric charging member cleaning roller 12*b* to the electric charging roller 12*a* at one side thereof is from about 1.5 [N] to about 2.5 [N].

Herein below, a problem raised in a conventional image forming apparatus is described. As a known system, a lubricant dispensing mechanism is installed in a process cartridge like an image forming unit 10 to prolong a life of a photoconductive drum. However, because the lubricant dispensing mechanism is expensive, a configuration capable of promoting life prolongation of the photoconductive drum without using the lubricant dispensing mechanism is demanded. More specifically, since a life span of the photoconductive drum greatly depends on abrasion of the photoconductive drum, a contact-type electrostatic charging device capable of providing fewer hazards to the photoconductive drum while more effectively suppressing the abrasion thereof than a non-contact-type electric charging device is demanded.

On the other hand, since the market demands a special sheet size (e.g., 329 [mm]×483 [mm]) slightly larger than A3 size (JIS: 297 [mm]×420 [mm]) by one size, a wider photoconductive drum in an axial direction than ever before is expected. At the same time, to downsize and lighten the process cartridge, a downsized and thinned photoconductive drum is also expected.

Figure 16A:
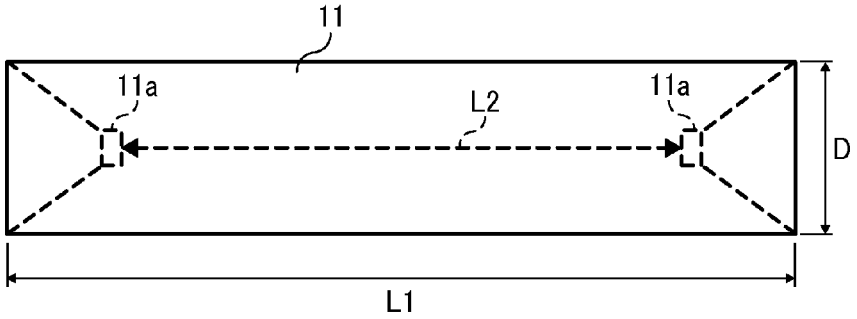
FIG. 16A is a front side view illustrating an exemplary photoconductive drum according to one embodiment of the present invention.
Figure 16B:
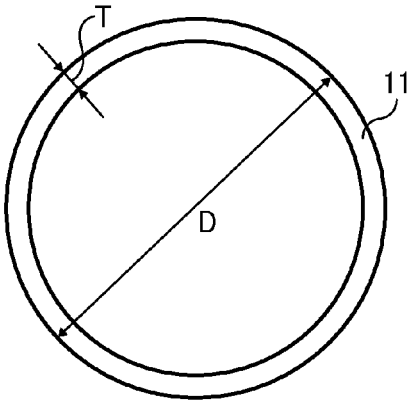
FIG. 16B is a cross-sectional view illustrating the photoconductive drum of FIG. 16A.

FIG. 16A is a front view schematically illustrating an exemplary dimension of the photoconductive drum 11 according to one embodiment of the present invention. FIG. 16B is a cross-sectional view schematically illustrating an exemplary dimension of the photoconductive drum 11 of FIG. 16A according to one embodiment of the present invention. A length L1 of the photoconductive drum 11 in its longitudinal direction is about 374 mm. A diameter D of a hollow cylindrical base material of the photoconductive drum 11 is about 30 mm. A thickness T of the base material is about 0.75 [mm] Also, in this embodiment, a pair of photoconductive drum bearing members 11*a* acting as bearings for the photoconductive drum 11 are located inboard of respective ends of the photoconductive drum 11 in the longitudinal direction. A distance L2 between these pair of photoconductive drum bearings is about 342 [mm].

Using the photoconductive drum 11 having such a small diameter with a thin base material capable of handling the special size sheet (larger than A3 size sheet by one size) and a similar image forming unit 10 to that as shown in FIG. 1, an image is formed by using an intermediate transfer system. In the image formation, as the electric charging roller 12*a*, a so-called crown shaped charging roller with a larger diameter at its longitudinal center than that at both ends thereof is used. That is, since the electric charging roller 12*a* is placed below the photoconductive drum 11, its own weight and counter-force against pressure applied to the photoconductive drum 11 cause it to separate from the photoconductive drum 11 at the longitudinal center when the longitudinal ends of electric charging roller 12*a* are supported and pressed against the photoconductive drum 11. Consequently, due to the deviation of the electric charging roller 12*a*, an electric charging nip 12*n* formed at that time at the longitudinal ends thereof is different from that formed at the longitudinal center. To solve such a problem, the crown shaped electric charging roller 12*a* is used. Specifically, an electric charging roller 12*a* having respective diameters of about 12 [mm] at one end and about 12.1 [mm] larger by 100 μm at a central region in the longitudinal direction thereof is used.

When the crown shape electric charging roller 12*a* is brought in contact with the photoconductive drum 11 in a stopped state and the nip width is measured, it is found that the nip width is slightly larger at a longitudinal end than that at the longitudinal center by a few lam. Here, as a photoconductive drum cleaning unit 15 in this example, the photoconductive drum cleaning unit used in the above-described second practical example is used.

Figure 17:
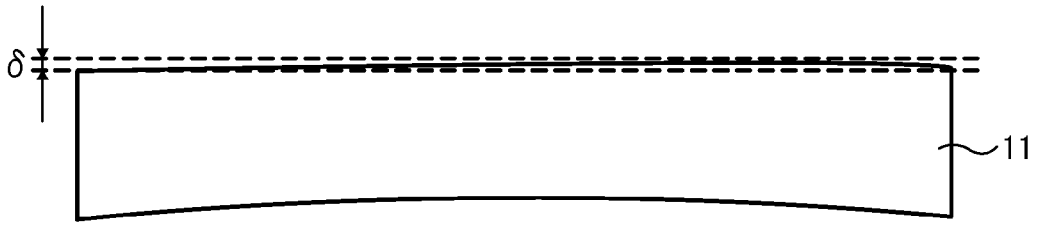
FIG. 17 is a diagram illustrating an exemplary state of the photoconductive drum when it is bent according to one embodiment of the present invention.

Further, in the image formation, it has been confirmed that a longitudinal center of the photoconductive drum 11 deforms toward the intermediate transfer belt 17 as shown in FIG. 17. In FIG. 17, 6 indicates an amount of central deformation generated by the photoconductive drum 11.

Figure 18:
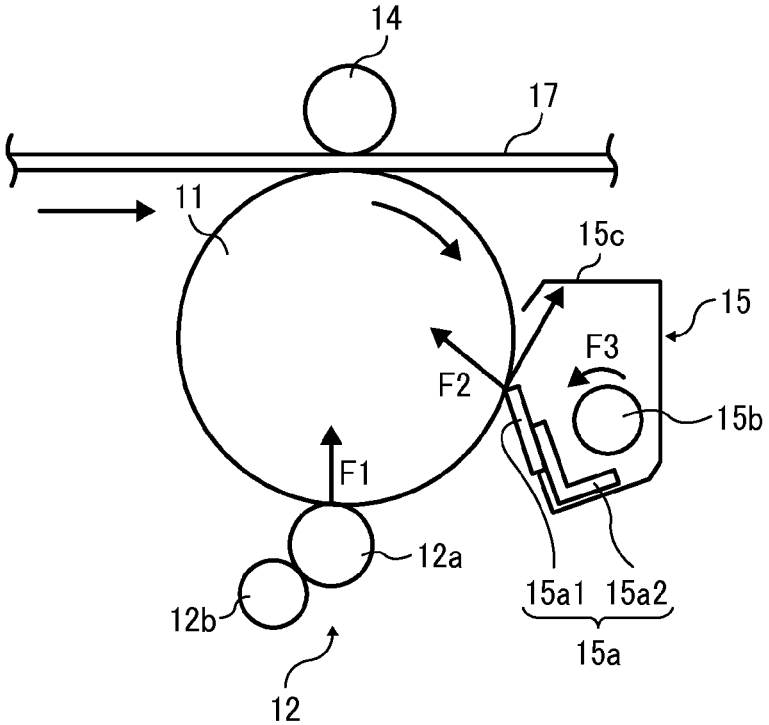
FIG. 18 is a diagram schematically illustrating exemplary force acting on the photoconductive drum when it is driven according to one embodiment of the present invention.

FIG. 18 is a diagram schematically illustrating various forces applied to the photoconductive drum 11 during operation thereof. A force acts upward as shown by arrow F1 in FIG. 18 as the electric charging roller 12*a* contacts the photoconductive drum 11 with pressure. A force shown by arrow F2 in FIG. 18 is applied by a cleaning blade unit 15*a* that contacts the photoconductive drum 11 with pressure toward the left upper side. Further, as the photoconductive drum 11 rotates clockwise in a direction indicated by the arrow in FIG. 18, friction caused between the cleaning blade unit 15*a* in sliding contact with the photoconductive drum 11 and the photoconductive drum 11 acts as shown by arrow F3 in FIG. 18.

These forces shown by arrows F1 to F3 in FIG. 18 act perpendicularly to the axis of the photoconductive drum 11 (extending perpendicularly to a plane of FIG. 18) and deform the photoconductive drum 11 upward with vertical upward components thereof. The photoconductor 11 downwardly deforms solely by its own weight at its longitudinal direction center. However, since the forces indicated by arrows F1 to F3 in FIG. 18 are larger than the force applied by its own weight, the photoconductive drum 11 deforms at the longitudinal center thereof to approach the intermediate transfer belt 17.

Figure 19:
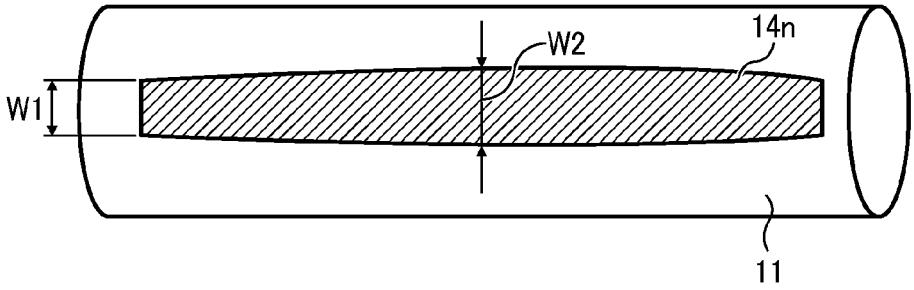
FIG. 19 is a diagram illustrating an exemplary primary transfer nip generated when the photoconductive drum is bent according to one embodiment of the present invention.

FIG. 19 is a diagram illustrating an exemplary primary transfer nip 14*n* serving as a primary transfer section formed at a abutment part between the photoconductive drum 11 and an intermediate transfer belt 17. As a result of the above-described image formation, it has been found that the nip width of the primary transfer nip 14*n* is different between the longitudinal center and the longitudinal ends, and in addition the difference therebetween is larger than a primary transfer nip of a conventional system. Specifically, as shown in FIG. 19, it is found that a transfer nip width W1 formed at each of the longitudinal ends in the primary transfer nip 14*n* is smaller than a transfer nip width W2 formed at the longitudinal center thereof. This is because, the closer to the longitudinal center of the photoconductive drum 11, the more the photoconductive drum 11 deforms and approaches the intermediate transfer belt 17. Further, during the image formation, silica acting as external additives for toner adheres to the longitudinal ends of the photoconductive drum 11, thereby having caused filming before the end of life of the image forming apparatus.

It is generally considered that when a difference in the nip width occurs in the primary transfer nip 14*n* between the longitudinal center and the longitudinal ends narrowing of the nip width, a transfer rate possibly decreases at the longitudinal end. However, the transfer rate does not decrease at the end in the longitudinal direction in the above-described image formation, and rather stabilized transfer performance is obtained. Because of this, the difference in nip width in the primary transfer nip 14*n* has a greater room to afford fluctuation in transfer rate than a room to afford filming of silica.

Since the silica is used in the above-described image formation as the external additives for toner, the silica adheres to the photoconductive drum 11 when the toner moves from the developing unit 13 to the photoconductive drum 11. Such silica is easily electrically charged to bear a negative polarity. Since a prescribed bias is applied to the primary transfer roller 14 acting as a transfer member in the primary transfer section, the silica is drawn to the primary transfer roller 14 and accordingly adheres to the intermediate transfer belt 17. However, because the nip width of the longitudinal ends of the primary transfer nip is narrower than that of the center thereof, a less amount of silica is peeled off from the longitudinal ends of the photoconductive drum 11 than that peeled off from its center. Hence, a more amount of silica continuously adheres to the longitudinal ends of this photoconductive drum 11 even after passing through the primary transfer section.

Since an adhesion on a surface of the photoconductive drum 11 passing through the primary transfer section is removed at a cleaning position at which a cleaning blade unit 15*a* contacts a surface of the photoconductive drum 11, the silica remaining on the photoconductive drum 11 is also removed there. However, when a large amount of silica adheres thereto, the cleaning blade unit 15*a* cannot fully remove the adhesion therefrom, so that some of silica passes through the cleaning position contacted by the cleaning blade unit 15*a*. Further, since the cleaning blade unit 15*a* rubs the silica against the surface of the photoconductive drum 11 when the silica passes through the above-described contact position, much silica continuously adheres to the longitudinal ends of the photoconductive drum 11. Consequently, the silica as foreign substance readily adheres firmly to the longitudinal ends of the photoconductive drum 11 thereby generating so called filming.

Also, since the silica passing through the abutment part between the cleaning blade unit 15*a* and the photoconductive drum 11 rushes into the abutment part again, an amount of adhesion of foreign substance such as silica, etc., further tends to increase. To avoid the silica from passing through the contact position after passing through the primary transfer section, and thereby preventing the foreign substance from firmly sticking to the longitudinal ends of the photoconductive drum 11, pressure of the cleaning blade unit 15*a* applied to the photoconductive drum 11 can be enhanced. However, when the contact pressure is raised like this, since a tremendously large force is applied onto the photoconductive drum 11 by an edge of the cleaning blade unit 15*a*, thereby promoting abrasion and reducing the life of the photoconductive drum 11. Because of this, even when a small size, light weight, low cost, and longitudinally long (i.e., wide) photoconductive drum 11 is used without a lubricant dispensing mechanism, abrasion of the photoconductive drum 11 and adhesion of foreign substance to longitudinal ends of the photoconductive drum 11 need to be inhibited.

According to the above-described first conventional technology, an electric charging member that contacts and charges an image bearer has a front surface mainly composed of conductive and non-conductive-abrasives made of conductive and non-conductive member, respectively. However, although the filming can be polished up by the above-described abrasives of the conventional electric charging member when it is generated, properties of a surface layer of the electric charging roller locally changes thereby necessitating a control system to control the electric charging roller, resulting in cost increase.

During continuous investigation, it has been found that in a system using a contact-type electric charging roller 12*a*, adhesion such as silica, etc., borne on the surface of the photoconductive drum 11 can be removed by the contact-type electric charging roller 12*a*. In general, since the electric charging roller 12*a* of this embodiment uniformly charges the surface of the photoconductive drum 11 with a negative polarity, adhesion such as silica, etc., bonded thereto with a charge having the negative polarity hardly adheres to the electric charging roller 12*a* electrostatically. Hover, the electric charging roller 12*a* removes the adhesion borne on the surface of the photoconductive drum 11 by contacting and mechanically scraping the adhesions from the photoconductive drum 11.

The wider the width of an electric charging nip in the abutment part between the electric charging roller 12*a* and the photoconductive drum 11, the more the electric charging roller 12*a* functions to remove the adhesion. However, when the electric charging nip is to be widened over the entire region in the longitudinal direction by increasing the pressure of the electric charging roller 12*a* that presses against the photoconductive drum 11, an amount of deformation of the photoconductive drum 11 further increases.

Figure 20:
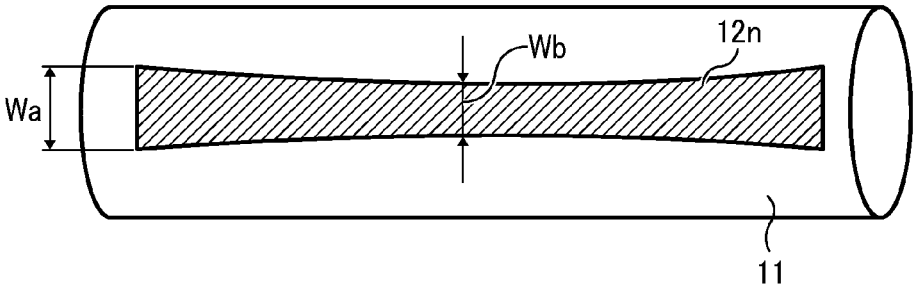
FIG. 20 is a diagram illustrating an exemplary electric charging nip according to one embodiment of the present invention.

Then, it is considered to encourage collection of the silica with the electric charging roller 12*a* by more widening the charging nip width at the longitudinal ends than longitudinal center thereof as shown in FIG. 20. FIG. 20 is a diagram illustrating an electric charging nip 12*n* as a abutment part formed between an electric charging roller 12*a* and a photoconductive drum 11 provided in an image forming unit 10 to which the present invention is applied. As shown there, an end charging nip width Wa formed at each of the ends of the electric charging nip 12*n* in the longitudinal direction thereof is set wider than a central transfer nip width Wb formed in the longitudinal center of the electric charging nip 12*n*. Here, the longitudinal ends represent ends of an image forming region on a surface of the photoconductive drum 11 in the longitudinal direction, in which a toner image is formed.

As a degree, the end charging nip width Wa is set to be wider than the central transfer nip width Wb by a greater amount than a deformation amount δ of the photoconductive drum 11 in this embodiment of the present invention to meet the following inequality: Wa−Wb>δ. The reason is as follows.

Firstly, it has been presumed that silica is more hardly removed at the longitudinal end in proportion to a difference between the central transfer nip width W2 and the end transfer nip width W1 caused by deformation of the photoconductive drum 11, and that the difference is almost equivalent to a deformation amount δ caused by the photoconductive drum 11 at the center thereof. Secondly, it has been also presumed that an average value of the nip width of the primary transfer nip 14*n* and that of the electric charging nip 12*n* are close to each other. Actually, these averages are measured and it is confirmed that these are substantially the same as are approximately 1.0 [mm] based on the estimation (presumption). Thirdly, it has been also presumed that collecting performance of an intermediate transfer belt 17 to collect silica from the photoconductive drum 11 at a primary transfer nip 14*n* per unit length of the nip width is substantially the same as that of the electric charging roller 12*a* that also collects silica from the photoconductive drum 11 at the electric charging nip 12*n* per unit length of the nip width. Fourthly, it has been also presumed that collecting performance of each of the intermediate transfer belt 17 and the electric charging roller 12*a* to collect silica is improved as each of the widths of the nips (i.e., the primary transfer nip 14*n* and the electric charging nip 12*n*) contacting the photoconductive drum 11 increases. To approve and confirm the above-described estimation (presumption), when the widths of the primary transfer nip 14*n* and the electric charging nip 12*n* are increased and decreased, it is found that the wider the nip width the better the collecting performance of silica from the photoconductive drum 11.

As the deformation amount δ grows, the central transfer nip width W2 in the primary transfer nip 14*n* increases, and accordingly collecting performance of the intermediate transfer belt 17 to collect silica from the photoconductive drum 11 can be improved. At this moment, however, the end transfer nip width W1 is reduced, and accordingly the silica easily lingers on the photoconductive drum 11 at its longitudinal ends. When the above-described third estimation is presumed to be true, and the end charging nip width Wa is widened more than the central charging nip width Wb by an amount more than a difference between the central transfer nip width W2 and the end transfer nip width W1, remaining of silica on the photoconductive drum 11 at the longitudinal ends thereof can be likely suppressed. Specifically, by meeting the below described relation, remaining of silica on the photoconductive drum 11 at the longitudinal ends thereof can be likely suppressed:

$$W2-W1 \leq Wa-Wb.$$

Further, when the above-described first estimation is assumed to be true, the below described relation can be established:

$$W2-W1=\delta.$$

At this moment, when the difference between the end charging nip width Wa and the central charging nip width Wb is set to be more than the deformation amount δ, the below described relation can be established:

$$\delta \leq Wa-Wb.$$

That is, a difference between the end charging nip width Wa and the central charging nip width Wb can be set more than the difference between the central transfer nip width W2 and the end transfer nip width W1.

Hence, when the above described first and third estimations (presumptions) are trues, and the end charging nip width Wa is widened more than the central charging nip width Wb by more than the deformation amount δ, remaining of silica on the photoconductive drum 11 at the longitudinal ends thereof can be likely suppressed. Hence, the end charging nip width Wa is set wider than the central charging nip width Wb by more than the deformation amount δ of the photoconductive drum 11. Herein below, various experiments having confirmed that remaining of silica on the photoconductive drum 11 at the longitudinal ends thereof can be suppressed are described using an easily deforming photoconductive drum 11 having the configuration in that the end charging nip width Wa is widened more than the central charging nip width Wb by more than the deformation amount δ of the photoconductive drum 11.

First, a consideration to be made prior to the experiments is described. Attention is paid to the a parameter of the quotient (division) obtained by dividing the second moment of area of a photoconductive drum 11 by the cube of its length as an indicator to indicate a deformation difficulty degree of the photoconductive drum 11 for the following reasons. That is, a drum-shaped photoconductive drum 11 is composed of a hollow cylindrical base material made of aluminum and a photoconductive layer overlying the surface of the hollow cylindrical base material. Material to form the photoconductive layer has a sufficiently lower stiffness than the aluminum of the hollow cylindrical base material, and accordingly stiffness of the hollow cylindrical base material contributes to the deformation difficulty degree of the photoconductive drum 11.

When a state in which forces of the electric charging roller 12*a* and the cleaning blade unit 15*a* are acting on the photoconductive drum 11 is simplified by a model in which the photoconductive drum 11 is substituted by a both ends supported beam that receives a concentrated load at a longitudinal center thereof, a deformation amount δ appearing at the longitudinal center is represented by following formula:

$$\delta=WL^3/48EI=W/48E\times L^3/I \quad \text{(A).}$$

In the above-described formula A, a reference letter W represents a value of a concentrated load, a reference letter L represents an axial length, a reference letter E represents a Young's modulus, and a reference letter I represents a moment of inertia.

Also, when a state in which a force is applied to a photoconductive drum 11 is simply substituted by a model in which the photoconductive drum 11 is regarded as a both ends supported beam that receives a distribution load over its longitudinal region, a deformation amount δ at the longitudinal center is represented by the following equation:

$$5WL^4/384EI=5WL/384E\times L^3/I \quad \text{(B).}$$

In the above-described formula B, a reference letter W represents a value of a distributed load, a reference letter L represents an axial length, a reference letter E represents a Young's modulus, and a reference letter of I represents a moment of inertia.

The concentrated load W in the above-described formula A represents the summation of forces applied by the cleaning blade unit 15*a* and the electric charging roller 12*a* to the photoconductive drum 11, and the product of multiplication of the distribution load W and the length L (i.e., w×L) in the above-described formula B is also a summation of forces applied to the photoconductive drum 11. Here, the Young's modulus E is determined depending on a kind of material of the base material of the photoconductive drum 11.

In any type of the above-described models of the formulas (A) and (B), the larger the value $L^3/I$, the larger the deformation amount 6. Since the larger the $I/L^3$ as an inverse of the value $L^3/I$, the more difficult the photoconductive drum 11 deforms, the quotient obtained by dividing the second moment of area $I/L^3$ by the cube of the length indicates a parameter that represents a difficulty in deformation of an object as far as the same material is used. In this embodiment, as material of the hollow cylindrical tube of the photoconductive drum 11, aluminum alloy (e.g., A1000 series, A2000 series, A5000 series, A6000 series, etc.) having a Young's modulus of from about $6.0\times10^{10}$ [$N/m^2$] to about $8.0\times10^{10}$ [$N/m^2$] is employed.

The second moment of area I of the hollow cylindrical member is represented by the following equation (i.e., expression):

$$I=\pi(D^4-d^4)/64 \quad \text{(C).}$$

In the above-described formula C, a Greek character reference it represents the ratio of the circumference of a circle to its diameter, a reference letter D represents an outer diameter of a hollow cylinder, and that of d represents an inner diameter of the hollow cylinder. The inner diameter d is obtained by subtracting two times of the thickness T from the diameter [D]. Thus, the parameter $I/L^3$ that represents a deformation difficulty degree of the photoconductive drum 11 decreases one of when a longitudinal length L of the photoconductive drum 11 grows, a diameter D of a cylindrical element tube is minimized, and a thickness T thereof decreases. That is, each of elongation of a photoconductive drum, reduction of a diameter thereof, and thinning thereof renders the photoconductive drum 11 to easily deform. Thus, when such an elongated, diameter reduced, or thinned photoconductive drum 11 is built in a system with the same configuration other than the photoconductive drum, the photoconductive drum 11 generates more amount of deformation δ than the conventional photoconductive drum 11.

The photoconductive drum 11 used in the experiment as a standard has a length L1 of about 374 mm, and a diameter D of about 30 mm, and includes a base material having a thickness T of about 0.75 [mm] as a as described above. The value of the parameter $I/L^3$ of this standard photoconductive drum is approximately 0.000145 [mm] In the conventional photoconductive drum, due to a larger diameter, being thicker, or a shorter axial length, the value of the parameter $I/L^3$ is not small as in the standard photoconductive drum. Then, seven photoconductive drums 11 are prepared by (differently) varying the thickness T of the base material of the standard photoconductive drum to change the value of $I/L^3$ other than the standard photoconductive drum 11, and total eight photoconductive drums 11 are experimented and investigated as described below.

As an electric charging roller 12*a* used in the following investigations and experiments, the so-called crown shaped roller having a larger diameter at a center in its longitudinal direction than that at its longitudinal ends is used. Specifically, by enlarging the central diameter more than a diameter of its one end having about 12 mm, the crown shaped-roll is obtained and used. The electric charging roller 12*a* also has a surface roughness of Rz (JIS) ranging from about 6 [μm] to about 18 [μm], and in particular, the electric charging roller 12*a* having a surface roughness of about 12 [μm] is used.

Now, as a first investigation, a result of an investigation of a balancing range that satisfies all of space saving (e.g., reduction of a diameter), cost and weight reduction (e.g., thinning), elongation or widening (e.g., a size capable of handling a sheet size larger than A3 (JIS) by a margin (i.e., a special sheet size)) of a photoconductive drum is shown in tables 1-1 and 1-2.

TABLE 1-1

| | | Quotient obtained by dividing the second moment of area by the cube of length | | | |
|---|---|---|---|---|---|
| | | 0.000029 | 0.000058 | 0.000087 | 0.000116 |
| * | 0.15 | OK | OK | OK | OK |
| mm | 0.1 | OK | OK | OK | OK |
| | 0.05 | OK | OK | OK | OK |
| | 0 | OK | OK | OK | OK |
| | −0.05 | OK | OK | OK | OK |

TABLE 1-2

| | | Quotient obtained by dividing the second moment of area by the cube of length | | | |
|---|---|---|---|---|---|
| | | 0.000145 | 0.000174 | 0.000203 | 0.000232 |
| * | 0.15 | OK | NG | NG | NG |
| mm | 0.1 | OK | NG | NG | NG |
| | 0.05 | OK | NG | NG | NG |
| | 0 | OK | NG | NG | NG |
| | −0.05 | OK | NG | NG | NG |

In this investigation, when a value $I/L^3$ is greater than that of the standard photoconductive drum, evaluation NG is allocated thereto for the reasons as described below. Specifically, in general, the standard photoconductive drum as is or one of a photoconductive drum having a smaller diameter than the standard photoconductive drum and a lighter photoconductive drum than the standard photoconductive drum are demanded. However, when it is attempted to prepare a photoconductive drum with a value $I/L^3$ greater than the normal photoconductive drum capable of handling the special size sheet, the diameter thereof needs to be increased or a sleeve thereof needs to be thickened more than the standard photoconductive drum and sleeve, respectively.

However, the increasing in diameter leads to enlargement of the photoconductive drum. Also, when a photoconductive drum having a small diameter and a greater value of $I/L^3$ than the standard photoconductive drum capable of handling the special sheet is used, a weight of the photoconductive drum likely increases consequently. The increasing in weight of the photoconductive drum leads to increasing in load during driving thereof and its logistic cost or the like. Hence, in this investigation, an evaluation NG is allocated to a situation in which the value $I/L^3$ is larger than that of the standard photoconductive drum.

In the Tables 1-1 and 1-2, a value indicated by * is obtained by calculating the following formula: *=(Wa−Wb)−δ. The value * is diversified by changing a crown-shape of the electric charging roller 12*a* contacting the photoconductive drum 11, and accordingly the end charging nip width Wa and the central charging nip width Wb. Then, a difference between the end charging nip width Wa and the central charging nip width Wb is measured.

These end charging nip width Wa and central charging nip width Wb are measured by a prescribed manner as described below. First of all, a photoconductive drum 11 bearing toner thereon and an electric charging roller 12*a* are assembled into an experimental system while pressing the electric charging roller 12*a* against the photoconductive drum 11 with a prescribed contact pressure. Then, such contact of the electric charging roller 12*a* is cancelled and the electric charging roller 12*a* is removed from the experimental system. As a result, toner adheres to a region of a surface of the electric charging roller 12*a*, which served as an electric charging nip 12*n* as shown in FIG. 20. A length of the region attracting the toner in a direction of rotation is measured at each of the longitudinal end and center to seek the end charging nip width Wa and the central charging nip Wb, respectively. Then, a value Wb−Wa is calculated based on a difference between the end charging nip width Wa and the central charging nip width Wb.

Here, as described heretofore, the calculated value Wb−Wa is obtained based on the information obtained (measured) when the photoconductive drum 11 is stopping. However, when the photoconductive drum 11 is driven, friction arises at a abutment part between the cleaning blade unit 15*a* and the photoconductive drum 11, and accordingly the value Wb−Wa likely grows when the photoconductive drum 11 is driven than when the photoconductive drum 11 stops. That is, the above described value Wb−Wa is, however, calculated when the photoconductive drum 11 is stopping in this experiment.

Figure 21:
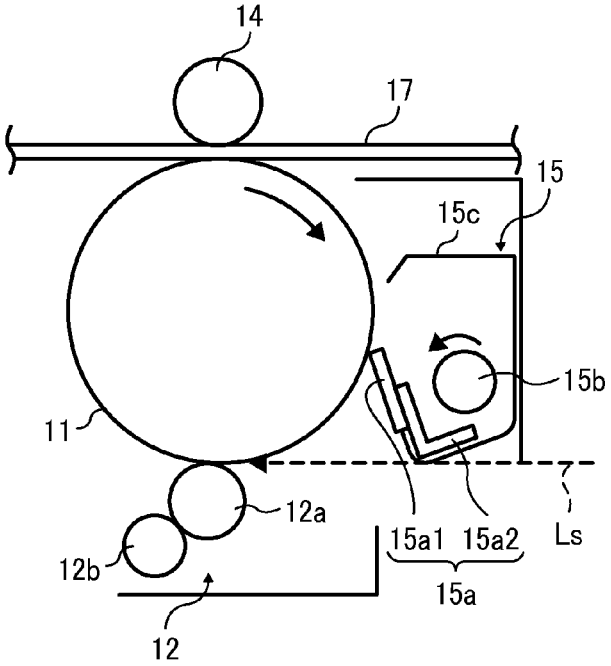
FIG. 21 is a conceptual diagram illustrating an exemplary method of measuring an amount of deformation of the photoconductive drum according to one embodiment of the present invention.

Further, the deformation amount δ is actually measured when the photoconductive drums 11 is driven, by contrast. That is, FIG. 21 is a conceptual diagram illustrating an exemplary method of measuring an amount of deformation of the photoconductive drum 11. In the drawing, arrow Ls indicates a direction of a laser beam used to measure a position of the bottom of the photoconductive drum 11 at a widthwise center thereof. Then, a difference in height of the bottom of the photoconductive drum 11 between a situation when the contact members (i.e., the cleaning blade unit 15*a* and the electric charging roller 12*a*) engaging with the photoconductive drum 11 as shown in FIG. 21 are disengaged therewith and that when the contact members are engaged therewith is sought. The difference in height obtained here serves as the deformation amount δ of the photoconductive drum 11 when it is driven.

With these measuring methods, the respective values (Wb−Wa), δ, and (*=(Wa−Wb)−δ) can be calculated and sought. Hence, the value * is diversified by changing the value Wb−Wa rather than the value δ. That is, by only changing the crown shape and accordingly the value Wb−Wa of the electric charging roller 12*a* while keeping forces (i.e., a contact pressure of the electric charging roller 12*a*, a contacting condition of the cleaning blade unit 15*a*) applied to the photoconductive drum 11 to be constant, the value * is diversified. The crown shape of the electric charging roller 12*a* is varied by either increasing or decreasing a diameter of a widthwise center having a larger size than the ends thereof having a diameter of about 12 [mm] By differentiating the crown shape in this way, the value * is set to have various values (i.e., −0.05, 0, 0.05, 0.1, 0.15) as listed on the tables 1-1 and 1-2 in multiple conditions of the photoconductive drum 11, respectively.

Next, a result of a second investigation, in which electric charging performance influenced by a difference in nip width of the electric charging roller is investigated, is described with reference to the below described tables 2-1 and 2-2.

TABLE 2-1

| | | Quotient obtained by dividing the second moment of area by the cube of length | | | |
|---|---|---|---|---|---|
| | | 0.000029 | 0.000058 | 0.000087 | 0.000116 |
| * | 0.15 | NG | OK | OK | OK |
| mm | 0.1 | OK | OK | OK | OK |
| | 0.05 | OK | OK | OK | OK |
| | 0 | OK | OK | OK | OK |
| | −0.05 | OK | OK | OK | OK |

TABLE 2-2

| | | Quotient obtained by dividing the second moment of area by the cube of length | | | |
|---|---|---|---|---|---|
| | | 0.000145 | 0.000174 | 0.000203 | 0.000232 |
| * | 0.15 | OK | OK | OK | OK |
| mm | 0.1 | OK | OK | OK | OK |
| | 0.05 | OK | OK | OK | OK |
| | 0 | OK | OK | OK | OK |
| | −0.05 | OK | OK | OK | OK |

The value $I/L^3$ is a parameter that represents a deformation difficulty degree of an object as far as material of the object is not changed. Thus, since when the value $I/L^3$ is excessively small, the photoconductive drum 11 easily deforms and the deformation amount δ increases, the value Wa−Wb needs to be a greater to satisfy the formula Wa−Wb>δ. When the value Wa−Wb is excessively great, a difference in electric charging potential used in an electric charging process (i.e., a value obtained by subtracting the absolute value of the photoconductive surface potential generated at the longitudinal center from the absolute value of the photoconductive surface potential generated at longitudinal ends) grows. When the difference in electric charging potential used in the electric charging process grows, image density of the longitudinal ends and center becomes different from each other. Thus, the tables 2-1 and 2-2 indicate an available and unavailable (i.e., OK and NG) range as a result of the investigation from this point of view. That is, in the tables 2-1 and 2-2, a reference sign OK indicates that a longitudinal difference of the electric charging potential (i.e., a difference between electric charging potentials respectively generated at widthwise ends and a center of the photoconductive drum 11) generated in the electric charging process for uniformly charging the photoconductive drum 11 does not apparently affect an image. By contrast, a reference sign NG in the tables 2-1 and 2-2 indicates that a longitudinal difference of the electric charging potential (i.e., a difference between electric charging potentials respectively generated at widthwise ends and a center of the photoconductive drum 11) caused in the electric charging process for uniformly charging the photoconductive drum 11 does apparently affect the image.

In the experimental system, when an average of a width of an electric charging nip 12*n* is about 1.0 [mm] and the value Wa−Wb becomes more than 0.2 [mm], the difference in electrostatic potential in the longitudinal direction (i.e., a difference between electric charging potentials respectively generated at widthwise ends and a center of the photoconductive drum 11) has apparently affected an image. Accordingly, the upper limit of the value Wa−Wb is set to about 0.2 [mm] That is, it is conventionally (simply) thought that electric charge irregularity caused by a difference in nip width in the electric charging nip 12*n* causes poor quality image. Then, in order to minimize the difference in nip width as much as possible, a shape of crown of the electric charging roller 12*a* is adjusted to set the value Wa−Wb to be close to zero. However, through continuous investigation, it is found in the experimental system that image quality caused by the electric charge irregularity is allowable when an average of a width of an electric charging nip 12*n* is about 1.0 [mm] and the value Wa−Wb is about 0.2 [mm] or less. Since the conventional electric charging roller 12*a* has a great shape of crown capable of cancelling the difference in electric charging nip 12*n*, the amount of conventional crown is considered to be excessive in terms of suppressing the poor image quality caused by the electric charge irregularity.

Here, the value of parameter $I/L^3$ of the above-described standard photoconductive drum is approximately 0.000145 [mm] The deformation amount δ of the standard photoconductive drum 11 is about 0.13 [μm] as well. By contrast, when the value of the parameter $I/L^3$ is about 0.000029 [mm] as shown in the left side in the table 2-1, the value of the parameter $I/L^3$ becomes about ⅕ of the standard photoconductive drum. When a photoconductive drum having the parameter $I/L^3$ of about ⅕ of the standard photoconductive drum is built in the same apparatus as the standard photoconductive drum, an amount of deformation 6 becomes five times of that of the standard photoconductive drum, because a load (W) and material (Young's modulus: E) are the same with each other. That is, the parameter $I/L^3$ indicates a deformation difficulty degree as described earlier. For this, when the value of the parameter $I/L^3$ is about 0.000029 [mm], the amount of deformation 6 becomes about 65 μm.

When the value * is about 0.1 and the formula (*=(Wa−Wb)−δ) is used, the value Wa−Wb is found to be about 0.165 [mm] and is accordingly below about 0.2 [mm] as the upper limit of the value Wa−Wb. On the other hand, when the value * is about 0.15 and the formula (*=(Wa−Wb)−δ) is used, the value Wa−Wb is found to be about 0.215 [mm] Since the value Wa−Wb exceed its upper limit of about 0.2 mm, a difference in the electrostatic potential (i.e., a difference between electric charging potentials respectively generated at widthwise ends and a center of the photoconductive drum 11) in the longitudinal direction apparently affects the image. Accordingly, as an evaluation, when the value of parameter $I/L^3$ is about 0.000029 [mm] and the value * is about 0.15, a reference sign NG is allocated as listed in tables 2-1 and 2-2.

Here, before evaluating an amount of residue of silica on the photoconductive drum 11, a first experiment is executed to investigate contact pressure of the cleaning blade unit 15*a* contacting the photoconductive drum 11. The amount of silica residue on the photoconductive drum 11 varies in accordance with contact pressure of the cleaning blade unit 15*a* of the photoconductive drum cleaning unit 15. The higher the contact pressure of the cleaning blade unit 15*a*, the higher the collection performance of the cleaning blade unit 15*a* to collect the silica. However, when the contact pressure of the cleaning blade unit 15*a* is excessive, surface abrasion of the photoconductive layer of the photoconductive drum 11 progresses, so that a more amount of carrier than an allowable range bonds thereto before the image forming apparatus reaches the end of life. By contrast, when the contact pressure of the cleaning blade unit 15*a* is low, not only the collection performance of the cleaning blade unit 15*a* to collect silica deteriorates, but also a defective image occurs at an early stage after start of usage due to defective cleaning.

Then, an experiment is executed to determine the contact pressure of the cleaning blade unit 15*a* as described below. An experimental system is prepared by remodeling a high voltage power source that drives a photoconductive drum and an electric charging system included in a commercially available image forming apparatus (e.g., Ricoh MP C 3503) as a DC electric charging system while using the above-described photoconductive drum(s) 11. With such an experimental system, a chronological change of carrier bonding and that of cleaning performance each caused by wearing of the photoconductive drum are investigated and evaluated while changing the contact pressure of the cleaning blade unit 15*a* against the photoconductive drum 11, and a result of the evaluation is listed on the below described tables 3-1 and 3-2.

TABLE 3

| | Central pressure of cleaning blade (g/cm) | | |
|---|---|---|---|
| | 10 | 25 | 40 |
| Adhesion of carrier | OK | OK | NG |
| Cleaning performance | NG | OK | OK |

In this experiment, as the contact pressures, linear loads of 10 g/cm, 25 g/cm, and 40 [g/cm] as central pressures are applied and investigated. Here, the central pressure is a linear load targeted when the cleaning blade unit 15*a* is mounted on the image forming unit 10. Thus, the contact pressure of the cleaning blade unit 15*a* is preferably the same as far as the cleaning blade unit 15*a* is installed in the same model. However, there are various tolerances in the cleaning blade unit 15*a*, such as a thickness tolerance, an overhanging amount tolerance, a mounting position tolerance, etc., because the cleaning blade unit 15*a* is prepared by mass production. When it is attempted to allow such a tolerance, the contact pressure accordingly varies per apparatus even if the image forming apparatus belongs to the same model. Thus, the central pressure represents contact pressure of the cleaning blade unit 15*a* when the cleaning blade unit 15*a* is assembled under an ideal condition in which the above-described tolerances are excluded.

Even if tolerance is allowed, upper and lower limits of the tolerance need to be set. For example, when the central pressure is about 25 g/cm, a linear load tolerance is set to about ±10 g/cm. Specifically, when setting of the central pressure is about 25 [g/cm], a contact pressure (a linear load) of the lower limit is about 15 [g/cm], and that of the upper limit is about 35 g/cm, accordingly. When setting of the central pressure is about 10 g/cm, a range of the linear load tolerance is narrower than the above-described range (i.e., ±10 g/cm). By contrast, when setting of the central pressure is about 40 g/cm, a range of the linear load tolerance is wider than the above-described range (i.e., ±10 g/cm).

Since the higher the contact pressure, the more the carrier bonds, evaluation is made based on a contact pressure corresponding to the upper limit of a linear load tolerance of a central pressure. For example, when setting of the central pressure is about 25 [g/cm], the evaluation is made based on the contact pressure of about 35 g/cm as the upper limit. Also, since the lower the contact pressure, the worse the cleaning performance, evaluation is made based on a contact pressure corresponding to the upper limit of a linear load tolerance of a central pressure. For example, when setting of the central pressure is about 25 [g/cm], the evaluation is made based on the contact pressure of about 15 g/cm as the lower limit. Here, as the photoconductive drum 11, the above-described standard photoconductive drum is employed.

A carrier bonding is a trouble caused by wearing of an aged photoconductive drum 11. To evaluate the carrier bonding when the photoconductive drum 11 has been rotated by the number of sheets corresponding to a life of the image forming unit 10 acting as a process cartridge, the following evaluation is made. First of all, a thickness of a photoconductive layer formed on the surface of the photoconductive drum 11 is measured before the photoconductive drum 11 is worn out. Subsequently, the photoconductive drum 11 is assembled into the experimental system while bringing the cleaning blade unit 15*a* in contact with the photoconductive drum 11 and applying the upper limits tolerances of linear loads respectively rendering the central pressures to be 10 g/cm, 25 g/cm, and 40 g/cm. Subsequently, a toner image is continuously formed on the surface of the photoconductive drum 11 in a print rate of 5[%] until the photoconductive drum 11 has been driven by the number of times corresponding to about 10,000 sheets, so that a photoconductive layer of the photoconductive drum 11 is worn out. Subsequently, the photoconductive drum 11 is drawn out of the experimental system, and the thickness of the photoconductive layer of the photoconductive drum 11 is measured again.

Then, the respective thicknesses of the photoconductive layers formed on the photoconductive drum 11 before and after its wearing out (i.e., before and after 10,000 sheets have been outputted) is compared to each other, and a reduction amount of thickness of the photoconductive layer is calculated under the respective conditions of the contact pressures corresponding to the central pressures 10 g/cm, 25 g/cm, and 40 [g/cm]. Subsequently, based on the above-described reduction amount of thickness, a reduction amount of thickness of the photoconductive layer when 60,000 sheets corresponding to the image forming apparatus lifetime has been printed is calculated for each of the contact conditions. Then, an estimated thickness of the photoconductive layer when 60,000 sheets have been outputted is calculated. Then, a photoconductive layer having in the estimated thickness as calculated in the above described manner is formed on a surface of the same base material as the standard photoconductive drum employs. Hence, multiple photoconductive drums 11 with photoconductive layers each having an expected thickness when 60,000 sheets have been outputted can be reproduced for respective conditions of the central pressures 10 g/cm, 25 g/cm, and 40 g/cm.

Then, these multiple photoconductive drums 11 having the thickness reduced layers as reproductions are built in the experimental system, and occurrence of carrier adhesion when images are formed is (investigated) confirmed, respectively. The investigation result is shown in table 3. In the Table 3, a reference sign OK indicates that career bonding does not affect image formation executed subsequently. A reference sign NG indicates that career bonding occurs by a degree unable to use in image formation executed subsequently.

To find the cleaning performance listed in the table 3, the following evaluation is made. New photoconductive drums 11 are assembled into respective experimenting apparatuses, and multiple cleaning unit 15 are then engaged with the photoconductive drums 11 by applying linear loads of the lower tolerance limits respectively rendering central pressures to be 10 g/cm, 25 g/cm and 40 [g/cm]. Subsequently, evaluation is made in each of the experimental systems about whether or not prescribed cleaning performance is kept when 10000 sheets of solid toner images have been formed on the photoconductive drum and subjected to a cleaning process of the cleaning unit 15 thereafter.

Whether or not the cleaning performance has been kept is evaluated by whether or not a stripe image is present or absent for the reasons as described below. Specifically, when defective cleaning happens, toner passing through a cleaning nip as a contact position of the cleaning blade unit 15*a* reaches an electric charging nip 12*n* as a contact position of the electric charging roller 12*a* located downstream of the cleaning nip. A stripe image appears due to surface dirt of the electric charging roller 12*a* when the toner adheres to the electric charging roller 12*a* in the electric charging nip 12*n*. For such reasons, when a stripe image occurs after 10000 sheets of solid toner images are formed, a reference sign NG is given as an evaluation therefor. By contrast, when a stripe image does not occurs even thereafter, a reference sign OK is given as an evaluation therefor.

Hence, as shown in the table 3, by setting a central pressure of the cleaning blade unit 15*a* to about 25 g/cm, a room to afford chronological career adhesion to the photoconductive drum and cleaning performance (of the cleaning blade) can be ensured at the same time even when the photoconductive drum wears away.

In the below described experiment that evaluates (investigates) a residual amount of silica on the photoconductive drum 11, the central pressure of the cleaning blade unit 15*a* is set to about 25 g/cm. Also, in the below described experiment, when an amount of deformation of the photoconductive drum 11 is measured as described with reference to FIG. 21, the central pressure of the cleaning blade unit 15*a* is set to about 25 g/cm again.

Now, a second experiment that evaluates about compatibility (coexistence) of shaving of a photoconductive drum 11 and adhesion of silica to longitudinal ends of the photoconductive drum 11 is herein below described. The central pressure of the contact pressure of the cleaning blade unit 15*a* pressing against the photoconductive drum 11 is set to about 25 g/cm. Under the above-described contact condition, when images each having an area ratio of about 5 [%] are continuously formed in a reference environment until the photoconductive drum 11 is driven by a distance of about 10 km, conditions of the adhesion and the image are observed, and an observation result is shown in tables 4-1 and 4-2. In the second experiment, an image is formed using a commercially available image forming apparatus (e.g., RICOH MP C3503) while modifying setting thereof in accordance with an experimental condition employed therein.

TABLE 4-1

| | | Quotient obtained by dividing the second moment of area by the cube of length | | | |
|---|---|---|---|---|---|
| | | 0.000029 | 0.000058 | 0.000087 | 0.000116 |
| * | 0.15 | OK | OK | OK | OK |
| mm | 0.1 | OK | OK | OK | OK |
| | 0.05 | OK | OK | OK | OK |
| | 0 | NG | NG | NG | NG |
| | −0.05 | NG | NG | NG | NG |

TABLE 4-2

| | | Quotient obtained by dividing the second moment of area by the cube of length | | | |
|---|---|---|---|---|---|
| | | 0.000145 | 0.000174 | 0.000203 | 0.000232 |
| * | 0.15 | OK | OK | OK | OK |
| mm | 0.1 | OK | OK | OK | OK |
| | 0.05 | OK | OK | OK | OK |
| | 0 | NG | NG | NG | NG |
| | −0.05 | NG | NG | NG | NG |

To obtain the tables 4-1 and 4-2, the photoconductive drum 11 is evaluated based on the below described evaluation criterion after the photoconductive drum 11 has been driven by a driving distance of about 10 km. That is, a reference sign OK indicates that adhesion of silica is not visible at all on the surface of the photoconductive drum 11 at its both ends in the longitudinal direction. A reference sign Almost indicates that adhesion of silica is visually confirmed on the surface of the photoconductive drum 11 at its both ends in the longitudinal direction, but it does not affect the image. A reference sign NG indicates that adhesion of silica can be visually confirmed on the surface of the photoconductive drum 11 at its both ends in the longitudinal direction, and it does affect the image as well.

Now, a third experiment that evaluates (investigates) about compatibility (coexistence) of shaving of a photoconductive drum 11 and adhesion of silica to longitudinal center of the photoconductive drum 11 is herein below described. The central pressure of the contact pressure of the cleaning blade unit 15*a* pressing against the photoconductive drum 11 is set to about 25 g/cm again. Under the above-described contact condition, when images each having an area ratio of about 5 [%] are continuously formed in a reference environment until the photoconductive drum 11 is driven by a distance of about 10 km, conditions of the adhesion and the image are observed, and an observation result is shown in tables 5-1 and 5-2. Also in the third experiment, an image is formed using the commercially available image forming apparatus (e.g., RICOH MP C3503) while modifying setting thereof in accordance with an experimental condition employed therein.

TABLE 5-1

| | | Quotient obtained by dividing the second moment of area by the cube of length | | | |
|---|---|---|---|---|---|
| | | 0.000029 | 0.000058 | 0.000087 | 0.000116 |
| * | 0.15 | Almost | Almost | Almost | Almost |
| mm | 0.1 | OK | OK | OK | OK |
| | 0.05 | OK | OK | OK | OK |
| | 0 | OK | OK | OK | OK |
| | −0.05 | OK | OK | OK | OK |

TABLE 5-2

| | | Quotient obtained by dividing the second moment of area by the cube of length | | | |
|---|---|---|---|---|---|
| | | 0.000145 | 0.000174 | 0.000203 | 0.000232 |
| * | 0.15 | Almost | Almost | Almost | Almost |
| mm | 0.1 | OK | OK | OK | OK |
| | 0.05 | OK | OK | OK | OK |
| | 0 | OK | OK | OK | OK |
| | −0.05 | OK | OK | OK | OK |

To obtain the tables 5-1 and 5-2, the photoconductive drum 11 is evaluated (investigated) based on the below described evaluation criterion after the photoconductive drum 11 has been driven by a driving distance of about 10 km. That is, a reference sign OK indicates that adhesion of silica is not visible at all on the surface of the photoconductive drum 11 at the longitudinal center thereof. A reference sign Almost indicates that adhesion of silica is visually confirmed on the surface of the photoconductive drum 11 at the longitudinal center thereof, but it does not affect the image. A reference sign NG indicates that adhesion of silica can be visually confirmed on the surface of the photoconductive drum 11 at the longitudinal center thereof, and it does affect the image as well.

As described above, since a portion of the photoconductive drum 11 deforms and approaches the intermediate transfer belt 17 by a greater degree as it nears to the longitudinal center thereof, the silica borne on the longitudinal center of the photoconductive drum 11 is easily collected by the intermediate transfer belt 17. However, as shown in tables 5-1 and 5-2, when the value * is about 0.15, adhesion of silica grows in the longitudinal direction center as a problem probably for the reasons as described below.

That is, the intermediate transfer belt 17 electrostatically collects the silica charged to have a negative polarity. Whereas, the electric charging roller 12*a* collects adhesions on the surface of the photoconductive drum 11 by mechanically scraping thereof therefrom. Because of this, since it has a small amount of charge having the negative polarity and is hardly collected by the intermediate transfer belt 17, the silica needs to be collected by the electric charging roller 12*a*. Out of the silica adhering to the surface of the photoconductive drum 11, a great majority of silica charged with the negative polarity is collected by the intermediate transfer belt 17 at its longitudinal center. Whereas, a small amount of silica having a small amount of charge can be preferably collected by the electric charging roller 12*a* even if collection ability of the electric charging roller 12*a* deteriorates.

Even it is a small amount, the silica with a small amount charge needs to be collected by the electric charging roller 12. It is considered, however, when the value * is about 0.15, a central charging nip width Wb becomes narrower, so that ability of the electric charging roller to collect the silicon at the longitudinal center 12*a* thereof becomes insufficient, and accordingly, the adhesion of silica may grow up there as a result.

When the value * is less than zero, although the evaluation became NG in the tables 4-1 and 4-2, the evaluation is Almost in the tables 5-1 and 5-2 even if the value * is 0.15 as the Maximum in the evaluated range. Accordingly, within an evaluated range of the value * (i.e., from about −0.05 to about 0.15), the longitudinal center has a room to allow a more amount of adhesion of silica as a result. The below described multiple tables 6-1 and 6-2 collectively indicate a table that summarizes the tables 1, 2, 4, and 5.

TABLE 6-1

| | | Quotient obtained by dividing the second moment of area by the cube of length | | | |
|---|---|---|---|---|---|
| | | 0.000029 | 0.000058 | 0.000087 | 0.000116 |
| * | 0.15 | NG | Almost | Almost | Almost |
| mm | 0.1 | OK | OK | OK | OK |
| | 0.05 | OK | OK | OK | OK |
| | 0 | NG | NG | NG | NG |
| | −0.05 | NG | NG | NG | NG |

TABLE 6-2

| | | Quotient obtained by dividing the second moment of area by the cube of length | | | |
|---|---|---|---|---|---|
| | | 0.000145 | 0.000174 | 0.000203 | 0.000232 |
| * | 0.15 | Almost | NG | NG | NG |
| mm | 0.1 | OK | NG | NG | NG |
| | 0.05 | OK | NG | NG | NG |
| | 0 | NG | NG | NG | NG |
| | −0.05 | NG | NG | NG | NG |

As understood from the tables 6-1 and 6-2, when the parameter $I/L^3$ is between about 0.000058 [mm] or more and about 0.000145 [mm] or less while the value * is about 0 [mm] or more, an abnormal image generally caused by adhesion of silica at ends in the longitudinal direction can be likely prevented. Similarly, when the value * is about 0.15 or less, an abnormal image generally caused by adhesion of silica at both ends and a center in the longitudinal direction can be likely prevented. With this, a photoconductive drum having the parameter $I/L^3$ of about 0.000145 [mm] or less capable of space saving (i.e., a small size), cost reduction (i.e., thinning), and elongation (i.e., handling a special-sized sheet) can prevent occurrence of the abnormal image generally caused by the adhesion of silica. Also, by setting the value Wa−Wb to be larger than the value δ and less than 0.2 [mm], the abnormal image generally caused by the adhesion of silica at ends in the longitudinal direction and poor image quality generally caused by the electric charge irregularity can be prevented at the same time.

Conventionally, there exists an image forming apparatus rendering the value * to be more than 0 [mm] However, because a photoconductive drum used in the conventional image forming apparatus has ether a large diameter or a short length (width), it hardly deforms, i.e., has a sufficiently larger value of parameter $I/L^3$ than the photoconductive drum use in the various embodiments of the present invention. That is, when the parameter $I/L^3$ is large enough, a photoconductive drum hardly deforms, and accordingly an amount of deformation 6 is minimized. Therefore, in a conventional image forming apparatus, even if an end charging nip width Wa is even slightly larger than a central charging nip Wb, a value * calculated by the following formula is greater than about 0 [mm];

$$*=(Wa-Wb)-\delta.$$

However, the value * is positive in this way simply because the image forming apparatus employs a photoconductive drum that very hardly deforms not to cause adhesion of silica at ends in the longitudinal direction thereof. Thus, such a conventional image forming device is different from the image forming apparatus of various embodiment of the present invention that uses an easy deforming photoconductive drum rendering the value * to be positive to prevent the adhesion of silicon in its longitudinal ends.

In a stopped state, the photoconductive drum 11 deforms due to contact pressures applied by the electric charging roller 12*a* and the cleaning blade unit 15*a*. However, when the photoconductive drum 11 is driven, since friction force caused by the cleaning blade unit 15*a* is added thereto, the photoconductive drum 11 largely deforms as a result. When the photoconductive drum 11 largely deforms in this way, since a longitudinal center of the photoconductive drum 11 is displaced away from the electric charging roller 12*a*, a central charging nip width Wb becomes smaller. When the central charging nip width Wb becomes smaller, a linear load at the longitudinal center of the electric charging nip 12*n* also decreases. However, a size of load applied by the electric charging roller 12*a* to the photoconductive drum 11 does not change, the linear load in the electric charging nip 12*n* grows at the longitudinal ends thereof. When the linear load in the electric charging nip 12*n* grows at the longitudinal ends, the end charging nip width Wa grows as a result. Like this, when the stopping photoconductive drum 11 starts driving, since the central charging nip width Wb becomes smaller while enlarging the end charging nip width Wa, the value Wa−Wb grows as a result.

In the experimenting result shown in the above-described tables 5-1 and 5-2 of, it is noted that adhesion of silica to the longitudinal center as a problem caused widening the end charging nip width Wa is evaluated as Almost even when the value * is about 0.15 as the maximum in the evaluated range. From this, it is understood that there yet exists a room to afford the adhesion of silica even when the end charging nip width Wa is widened thereby enlarging the value *.

On the other hand, when the experimenting result shown in the above-described tables 4-1 and 4-2 is referred, it is noted that adhesion of silica to the longitudinal end as a problem caused by reduction of the end charging nip width Wa is evaluated as NG when the value * is zero or less. From this, it is understood that there is almost no room to afford the adhesion of silicon under a condition in which the end charging nip width Wa becomes narrower while the value * is minimized.

Figure 22:
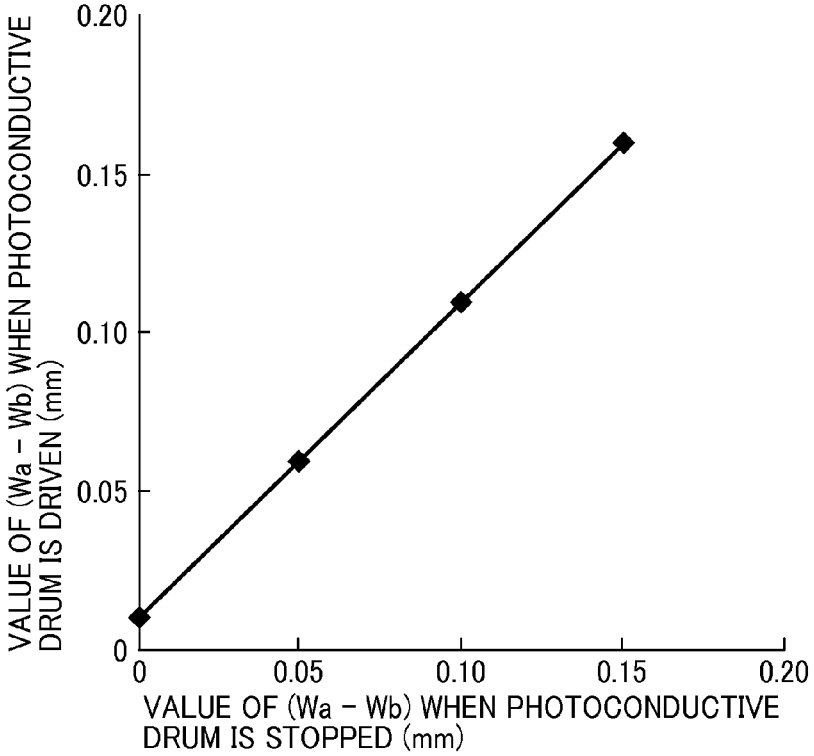
FIG. 22 is a graph illustrating an exemplary relation between differences in width of the electric charging nip respectively generated when the photoconductive drum is stopped and is driven according to one embodiment of the present invention.

FIG. 22 is a graph illustrating an exemplary relation between differences in charging nip width (i.e., Wa−Wb) caused when (the photoconductive drum 11) stops and that caused when it is driven, respectively. As shown there, a straight line has an inclination rate of one with an intercept of 0.01 on a vertical axis. That is, it is presumed that there is a correlation between the value Wa−Wb generated during the stop of operation (of the photoconductive drum 11) and the value Wa−Wb generated during the operation thereof as shown in FIG. 22.

In the above described experiment, the value Wa−Wb is diversified by changing a shape of crown of each of the electric charging rollers 12*a* contacting the respective photoconductive drums 11. Thus, even when the value of Wa−Wb is changed (differentiated), the total load W acting on the photoconductive drum 11 (is substantially the same). Further, an amount of load W increasing when the stopping photoconductive drum 11 starts driving while receiving the friction force from the cleaning blade unit 15*a* is substantially the same even when a shape of the crown of the electric charging roller 12*a* is charged (differentiated).

In the above-described experiment, since the value $I/L^3$ and the load W are constant (i.e., the same) unless otherwise the photoconductive drum 11 is replaced with another photoconductive drum 11 having a different thickness, an amount of deformation thereof becomes constant (i.e., the same) as well. Further, because an amount of load W increased when the stopping photoconductive drum 11 starts rotating (i.e., driving) is also constant, an amount of deformation of the photoconductive drum 11 increased at the same time (i.e., when the stopping photoconductive drum 11 starts rotating (i.e., driving)) is also constant as well. Here, as mentioned above, the value of Wa−Wb accordingly grows when the amount of deformation of the photoconductive drum 11 grows. However, when the increased amount of deformation of the photoconductive drum 11 is constant, the increased amount of the value Wa−Wb becomes also constant as well.

Accordingly, it is estimated that even when the value Wa−Wb obtained during the stop of operation is changed by differentiating the shape of the crown of the electric charging roller 12*a*, an increased value of Wa−Wb obtained when the stopping photoconductive drum 11 starts operating (i.e., driving) is constant as shown in FIG. 22. Specifically, in FIG. 22, even when the value Wa−Wb is zero during the stop of operation, i.e., the end charging nip width Wa and the central charging nip Wb are the same, the end charging nip width Wa increases up to about 0.01 [mm] when the photoconductive drum 11 starts driving.

Further, as shown in FIG. 22, when a vale Wa−Wb obtained during the stop of operation of the photoconductive drum 1 is about 0.05 [mm], a vale Wa−Wb obtained during the operation thereof is about 0.06 [mm] Again, an increased amount of Wa−Wb obtained when the photoconductive drum 1 starts driving after the stopping state is about 0.01 [mm] as same as when the value Wa−Wb obtained during the stop of operation of the photoconductive drum 1 is about 0 [mm].

Similarly, when a vale Wa−Wb obtained during the stop of operation is about 0.1 [mm], a vale Wa−Wb obtained during the operation thereof is about 0.11 [mm] Also, when the vale Wa−Wb obtained during the stop of operation is about 0.15 [mm], the vale Wa−Wb obtained during the operation thereof is about 0.16 [mm] In this way, even when the value Wa−Wb obtained during the stop of operation varies, an increased value of Wa−Wb obtained when it is driven from a stopping state amounts to about 0.01 [mm] Although, in FIG. 22, as a just one example, a situation in which the increasing amount of the Wa−Wb is constantly about 0.01 [mm] is described, the increasing amount of the Wa−Wb varies depending on various conditions.

Here, the reference symbol * shown in the above-described tables 6-1 and 6-2 indicates a difference between a value Wa−Wb obtained during the stop of operation of the photoconductive drum 11 and the deformation amount δ of the photoconductive drum 11 during the operation (driving) thereof. Since a value Wa−Wb obtained during driving of the photoconductive drum 11 is larger than that obtained during stopping thereof, a difference between the Wa−Wb value and the deformation amount δ of the photoconductive drum 11 each obtained during driving thereof becomes larger than the value * shown in the tables 6-1 and 6-2. As described above, within the experienced range, it is noted that there is almost no room to allow a situation in which the value * decreases. However, there is a room to allow a situation in which the value * increases, no problem occurs even when the value * obtained during the driving of the photoconductive drum 11 grows from that obtained during the stop of driving thereof. Further, when the value * that indicates a difference between the value Wa−Wb during the stop of operation of the photoconductive drum 11 and the deformation amount δ of the photoconductive drum 11 during the operation (driving) thereof is larger than zero, occurrence of adhesion of silicon in both longitudinal ends of the photoconductive drum 11 can be reduced.

Further, when the photoconductive drum 11 deforms upon receiving forces from the cleaning blade unit 15*a* and the electric charging roller 12*a* each engaging therewith, the central transfer nip width W2 increases and whereas the end transfer nip width W1 decreases in the primary transfer nip 14*n*. Accordingly, a more amount of silica remains on the surface of the photoconductive drum 11 at both ends in the longitudinal direction than the other portion thereon after passing through the primary transfer nip 14*n*. Subsequently, the amount of silicon initially rushed into the cleaning nip or that of silica rushed again into the cleaning nip after initially passing through the cleaning nip increases at the both ends in the longitudinal direction thereof. Because of this, foreign substances can easily adhere to the surface of the photoconductive drum 11 at the both ends in the longitudinal direction thereof.

On the other hand, when a width of the electric charging nip acing as the abutment part between the electric charging roller 12*a* contacting the photoconductive drum 11 and the photoconductive drum 11 is enhanced, an amount of silica scraped off by the electric charging roller 12*a* from the photoconductive drum 11 accordingly increases. In addition, when an electric charging roller cleaning unit such as the electric charging member cleaning roller 12*b*, etc., is engaged with the electric charging roller 12*a*, ability of the electric charging roller 12*a* to scrap off the silica can be kept for a long time.

In this embodiment, since the end charging nip width Wa is enhanced to be larger than the central charging nip width Wb by a more amount of deformation of the photoconductive drum 11, the amount of silica to re-enter the cleaning nip can be reduced. Also, the adhesion of foreign substances in longitudinal ends of the photoconductive drum 11 can be inhibited as well. Also, by engaging the charging roller cleaning unit with the electric charging roller 12*a* that scrapes off the silica from the photoconductive drum 11, ability of the electric charging roller 12*a* to scrap off the silica can be kept for a long time as well.

In the above-described embodiment, as an electric charging member, a roller-shaped electric charging roller 12*a* is used. However, as far as it is a contact-type electric charging member that contacts the photoconductive drum 11 and is able to form an electric charging nip, the present invention is not limited to the roller-shaped electric charging roller 12*a* and includes another type as well. However, unless otherwise than a device like the surface moving electric charging roller 12*a*, the another type may require a mechanism to separate the electric charging member from the photoconductive drum 11 and remove the foreign substances such as silica, etc., adhering to a surface in an electric charging nip on a regular basis, thereby causing a risk of complicating an apparatus at high cost. On the other hand, since the copy machine 100 of this embodiment uses a surface movable electric charging roller 12*a* acting as a roller member, it can always engage a fresh face completing a cleaning process with the photoconductive drum 11 thereby being able to keep ability of scraping off the silica. In addition, since a mechanism to disengage the electric charging member from the photoconductive drum 11 to remove the foreign substances such as silica, etc., is not required, performance of scraping off the silica can be kept for a long time at low cost.

The electric charging roller 12*a* has a surface roughness Rz of about 5 μm or more when measured based on a 10 points surface roughness, so that silica hardly chronologically adheres to and remains on a portion from which it is scraped off by the electric charging roller 12*a*, and accordingly performance thereof to scrape off the silica hardly deteriorates.

That is, out of surface portions of microscopic irregularities of the electric charging roller 12*a*, a surface portion to scrape off the silica from the surface of the photoconductive drum 11 is a convex portion of the microscopic irregularities. Specifically, although the silica scraped off by the convex portion accumulates in recesses of the microscopic irregularities, the silica adhering to the convex portions at the time is removed by the electric charging member cleaning roller 12*b*. Performance of the electric charging roller 12*a* to scrape off the silica is influenced by an amount of silica remaining in the convex portions on the surface of the electric charging roller 12*a*. Further, in proportion to a value of Rz, i.e., a height of a convex portion of a surface, silica accumulating in the convex portion becomes easily removed by the electric charging member cleaning roller 12*b* and the silica hardly accumulates on the convex portion at the same time as well, so that performance of the electric charging member cleaning roller 12*b* to scrape off silica hardly deteriorates. Here, some of toner scraped off by the convex portion of the surface of the electric charging roller 12*a* from the surface of the photoconductive drum 11 moves to and enters the recesses on the electric charging roller 12*a*. However, although the silica continuously adheres to the recesses, an impact thereof onto performance of the convex portion to scrape off the silica is small.

As shown in FIG. 1, in the copy machine 100 of this embodiment, the electric charging roller 12*a* is placed below a rotational axis of the photoconductive drum 11 to vertically press against the photoconductive drum 11 from below the photoconductive drum 11. The electric charging roller 12*a* downwardly deforms by its own weight at its longitudinal center. However, with such a configuration in which the electric charging roller 12*a* upwardly presses against the photoconductive drum 11 from below the photoconductive drum 11, pressure applied from the longitudinal center deforming by its own weight can be reduced while enhancing the pressure of the longitudinal ends. Hence, performance to scrape off the silica at both ends in the longitudinal direction can be improved with a less expensive configuration.

In the copy machine 100, both ends of the electric charging roller 12*a* are pressed against the photoconductive drum 11. With such a both end pressing system, pressure applied to the longitudinal ends can be enhanced constantly while enabling to constantly maintain the silica scraping off performance of the electric charging roller 12*a* at the both ends.

The electric charging member cleaning unit provided in the copy machine 100 includes an electric charging member cleaning roller 12*b* acting as the electric charge cleaning unit that contacts the surface of the electric charging roller 12*a* to remove foreign substances therefrom. This electric charging member cleaning roller 12*b* is made of material containing foaming urethane. Since the foaming urethane has a large cell diameter, silica adhering to an electric charging roller 12*a* is readily scraped off by the foaming urethane therefrom, performance of the electric charging roller 12*a* to scrape off silica therefrom can be maintained constantly as well.

The electric charging member cleaning roller 12*b* has a roller shape. Thus, since it has such a roller shape, the electric charging member cleaning unit can increase its abutment part contacting the electric charging roller 12*a* more than a blade-shaped electric charge cleaning unit. Hence, performance of the electric charging roller 12*a* to scrape off the silica for a long time can be improved with a less expensive configuration.

Similarly, both ends of the electric charging member cleaning roller 12*b* acting as an electric charging member cleaning unit in its longitudinal direction are pressed against the electric charging roller 12*a*. Because the both sides of the electric charging member cleaning roller 12*b* are pressed, pressure in the longitudinal ends can be enhanced constantly, while enabling to constantly maintain the silica scraping off performance of the electric charging roller 12*a* there with a less expensive configuration.

As an absolute value of a surface potential of the photoconductive drum 11 uniformly charged by the electric charging roller 12*a* is desirably more than the ground voltage by about 140 [V] or more. That is, since an enlarged charge potential having a negative polarity is generated on the surface of the photoconductive drum 11, negatively charged silica is hardly supplied from the developing roller 13*a* to a non-image region of the photoconductive drum 11 at a developing region when it arrives there with the uniformly charged electrostatic potential. Hence, an amount of silica adhering to the photoconductive drum 11 can be suppressed. On the other hand, when the difference between the absolute value of a surface potential of the photoconductive drum 11 uniformly charged by the electric charging roller 12*a* and the ground voltage is below about 140 [v], performance to inhibit adhesion of silica to the photoconductive drum 11 likely deteriorates while actualizing background fog as well.

Further, a photoconductive drum cleaning unit 15 acting as a cleaning unit includes a cleaning blade unit 15*a* to contact the surface of the photoconductive drum 11 and remove residual toner remaining thereon after a transfer process. The cleaning blade unit 15*a* is composed of a blade-shaped member 15*a*1 acting as a body of the cleaning blade. The photoconductive drum cleaning unit 15 further includes a holder unit 15*a*2 acting as a blade holder to fix the blade-shaped member 15*a*1 onto the body of the photoconductive drum cleaning unit 15. Both ends of the holder unit 15*a*2 in its longitudinal direction as an axial direction are fixed. Since blade pressure can be enhanced and stabilized only at the ends of the blade. In the longitudinal direction, adhesion of foreign substances onto the surface of the photoconductive drum 11 in longitudinal ends can be suppressed. With this, adhesion of foreign substances onto the surface of the photoconductive drum 11 in longitudinal ends caused by defective cleaning, and accordingly filming caused by adhesion of silica can be also suppressed can be suppressed at the same time.

The photoconductive drum 11 is desirably configured to exclude insulating filler from a photoconductive layer. That is, smoothness of the surface of the photoconductive drum 11 increases when it does not contain the insulating fillers in the photoconductive layer. In addition, adhesion of silica to it in the developing region can be suppressed when the surface of the photoconductive drum 11 has higher smoothness. Further, the electric charging roller 12*a* can easily scrape off the silicon in the charging nip 12*n* at the same time as well. With this, the silica is not continuously left on the surface of the photoconductive drum 11 while adhering thereto, thereby likely preventing filming of the silica.

Further, the equivalent transfer current (ampere) to that applied during image formation is desirably applied to the transfer device such as the primary transfer roller 14, etc., even at a time that corresponds to a transfer sheet interval. That is, since the transfer current is applied to a blank section of the photoconductive drum 11, on which an image is not formed, such as the transfer sheet interval, etc., the silica can be removed from the blank section as well. Again, with this, silica is not continuously left on the surface of the photoconductive drum 11 while adhering thereto, thereby likely preventing filming of the silica.

Also, an image forming unit 10 of this embodiment at least integrally includes the photoconductive drum 11, the electric charging unit 12, and the photoconductive drum cleaning unit 15 collectively forming a process cartridge detachably installed in the copy machine 100. With this configuration, in the image forming unit 10 that can likely prevent filming of the silica on the deflective photoconductive drum 11, replacement performance of such integral expendable parts can be upgraded.

In the above-described various embodiments, the present invention is applied to an image forming apparatus with a developing unit 13 that employs a two-component developing system using two-component developer. However, the present invention can be also applied to an image forming apparatus with a developing unit 13 that employs a one-component developing system using one-component developer as well.

Various embodiments of the present invention described heretofore are just typical examples and are able to provide the below described unique advantages per embodiment, respectively.

According to one aspect of the present invention, an image forming apparatus includes a rotatable latent image bearer, a rotatable electric charging member that electrically charges the surface of latent image bearer uniformly while forming an electric charging nip therebetween by contacting the surface of the latent image bearer, and a latent image writing device to form an electrostatic latent image on the surface of the latent image bearer uniformly charged by the electric charging member. A developing unit is provided to apply toner to and develop the electrostatic latent image borne on the latent image bearer. A transfer device is provided to transfer a toner image rendered visible by the toner adhering to the latent image bearer onto a transfer medium in a transfer process. A cleaning unit is provided to remove residual toner remaining on the latent image bearer after the toner image is transferred onto the transfer medium in the transfer process. An electric charging member cleaning unit is provided to remove foreign substances adhering to the surface of the electric charging device. A value obtained by dividing a moment of inertia of area of the latent image bearer by the cube of length of the latent image bearer ranges from about 0.000058 [mm] or more to about 0.000145 [mm] or less. A width of the electric charging nip in a direction of rotation at longitudinal ends of the latent image bearer is larger than that at a longitudinal center thereof. A difference between the width of the electric charging nip in the direction of rotation at the longitudinal ends of the latent image bearer and that at the longitudinal center thereof is larger than an amount of deformation of the latent image bearer generated during rotation at the longitudinal center thereof.

With this, occurrence of filming can be likely suppressed even in a configuration that employs a latent image bearer easy to deflect for the reasons as described below.

That is, the latent image bearer is easy to deflect more than a conventional latent image bearer because a value obtained by dividing the moment of inertia by the cube of length is below about 0.000145 [mm] A part of pressure of the electric charging member, provided in contact with the surface of the latent image bearer to form a charging nip thereon, acts on the latent image bearer to press it against a transfer nip in which a toner image is transferred onto a transfer medium. Also, at least some of the friction force and pressure of the cleaning blade each generated at a abutment part between the cleaning blade and the latent image bearer acts to press the latent image bearer against the transfer nip. In in this way, when a latent image bearer easy to deflect is employed and force to press the latent image bearer against the transfer nip operates, a longitudinal center of the latent image bearer deforms and approaches the transfer nip, and accordingly a width of the transfer nip grows at its longitudinal center. Since an average width of the total transfer nip almost does not vary unless otherwise pressure of the latent image bearer against the transfer member changes, a nip width in the longitudinal ends in the transfer nip decreases, when a nip width at the longitudinal center in the transfer nip grows. In the transfer nip, not only the toner on the latent image bearer, but also foreign substances move onto the transfer medium as well. However, when the width of the transfer nip decreases, an amount of moving foreign substances also decreases. Because of this, the larger the amount of deformation of the latent image bearer approaching the transfer nip at the longitudinal center thereof, the narrower the nip width in the longitudinal ends in the transfer nip. At the same time, an amount of foreign substances moving to the transfer medium in the transfer nip decreases and the foreign substances is rarely left adhering thereto while suppressing occurrence of filming on the latent image bearer. In this way, since the larger the deformation of the latent image bearer at the longitudinal center, the more frequently the filming occurs, the filming more frequently occurs on the latent image bearer in the longitudinal ends than a conventional latent image bearer when the above-described easy deflecting latent image bearer is used. The electric charging member contacting the latent image bearer can collect foreign substances borne on the latent image bearer, and its collecting performance tends to increase in proportion to a size of the charging nip width. Hence, like the first aspect of the present invention, by enlarging the side end charging nip width than the central charging nip width, collection of foreign substances by the electric charging member in longitudinal end can be promoted. Further, in the first aspect of the present invention, the side end charging nip width is set to be wider, so that a difference between the side end charging nip width and the central charging nip width is larger than an amount of central deformation of the latent image bearer caused when the latent image bearer is driven. As noted from a result of experiment as explained with reference to the above-described tables 6-1 and 6-2, it is found that when a difference between the side end charging nip width and the central charging nip width is below the amount of central deformation of the latent image bearer generated when it is driven, adhesion of the foreign substances to the longitudinal end of the latent image bearer is not sufficiently suppressed, even if the side end charging nip width is larger than the central charging nip width. On the other hand, it is confirmed that adhesion of the foreign substances to the longitudinal end of the latent image bearer is sufficiently suppressed when the side end charging nip width is set to be greater enough than the central charging nip width so that a difference between the side end charging nip width and the central charging nip width is more than the amount of central deformation of the latent image bearer generated when it is driven. Due to this, occurrence of filming caused by continuous adhesion of the foreign substances onto the latent image bearer in the longitudinal ends can be suppressed. Here, when a value obtained by dividing a moment of inertia of area by the cube of length is below 0.000058 [mm], since it excessively easily deforms, an amount of deformation of the latent image bearer grows thereby causing the following problems. Specifically, when it is attempted to set the difference between the side end charging nip width and the central charging nip width to be larger than the central deformation amount of the latent image bearer caused during operation of the latent image bearer, the difference between the side end charging nip width and the central charging nip width needs to be enlarged in proportion to an increased amount of deformation. However, when the difference is excessive, electric charge irregularity occurs on the latent image bearer in the axial direction thereof thereby generating a risk of producing poor image quality due to electric charge irregularity. Therefore, in this first aspect, only a latent image bearer is utilized, which meets (a deflecting condition) in which a value obtained by dividing a moment of inertia of area by the cube of length is about 0.000058 [mm] or more. In short, according to one aspect of the present invention, even with a latent image bearer more easily deflecting than a conventional latent image bearer, filming generally occurring at ends of the latent image bearer in the axial direction thereof can be effectively suppressed as a unique advantage.

According to another aspect of the present invention, the difference between the width of the electric charging nip in the direction of rotation at the longitudinal ends of the latent image bearer and that at the longitudinal center is below 2/10 (i.e., one-fifth) of an averaged width of the electric charging nip in the direction of rotation. With this, formation of a defective image due to electric charge irregularity can be likely prevented.

According to yet another aspect of the present invention, the electric charging member has a roller shape. With this, since a roller member capable of moving its surface is employed, a fresh face of the electric charging member having been subjected to its cleaning process can always contact the latent image bearer, thereby enabling to keep its performance of scraping off foreign substances such as silica, etc., therefrom. Also, because a mechanism to separate the electric charging member from the latent image bearer to remove foreign substances is no longer needed, performance of scraping off the foreign substances can be kept with a cheaper configuration for a long time.

According to yet another aspect of the present invention, a surface roughness Rz of the electric charging member is about 5 μm or more. With this, the foreign substances such as silica, etc., is hardly left unremoved in a portion of the electric charging member, from which the foreign substances are scraped off, so that performance of scraping off the foreign substances rarely deteriorates for a long time. That is, performance of the electric charging member to scrape off the foreign substances from the latent image bearer such as a photoconductive drum 11, etc., can be kept for a long time as well.

According to yet another aspect of the present invention, the electric charging member contacts the surface of the latent image bearer below a rotational axis of the latent image bearer. With this, pressure in a longitudinal center of the electric charging roller 12*a* deflecting by its own weight can be reduced while the pressure of the longitudinal ends thereof can be enhanced. Hence, performance of scraping off the foreign substances such as silica, etc., from the longitudinal ends can be improved with a less expensive configuration. According to yet another aspect of the present invention, both ends of the electric charging member are pressed against the latent image bearer. With this, pressure applied to the longitudinal ends in an electric charging nip can be enhanced constantly. At the same time, performance of scraping off silica from the longitudinal ends of the electric charging member can be maintained constantly.

According to yet another aspect of the present invention, an absolute value of a surface potential of the latent image bearer uniformly charged by the electric charging member is higher than the ground potential by about 140 [V] or more. With this, since foreign substances such as silica, etc., becomes hardly supplied from the developing unit accommodating a developing roller 13*a* to a latent image bearer in the non-image region, an amount of silica adhering to the latent image bearer can be reduced or suppressed.

According to yet another aspect of the present invention, the cleaning unit includes a cleaning blade in contact with the surface of the latent image bearer to remove residual toner remaining after the transfer process and a blade holder to fix the cleaning blade to a body of the image forming apparatus. Further, only both longitudinal ends of the blade holder are fixed to the cleaning unit. With this, adhesion of foreign substances onto a surface of a latent image bearer in the longitudinal end thereof due to defective cleaning can be likely inhibited. At the same time, filming caused by adhesion of foreign substances such as silica, etc., can be likely suppressed as well.

According to yet another aspect of the present invention, the latent image bearer includes a light-sensitive layer excluding insulating filler. With this, surface smoothness of the latent image bearer increases, adhesion of foreign substances such as silica, etc., can be reduced, and the foreign substances adhering to the latent image bearer can be readily scraped off by the electric charging member such as an electric charging roller 12*a*, etc. At the same time, since foreign substances are rarely continuously left on the surface of the latent image bearer while adhering thereto, occurrence of filming of the foreign substances can be suppressed.

According to yet another aspect of the present invention, a process cartridge attachable to a body of an image forming apparatus includes a rotatable latent image bearer, a rotatable electric charging member contacting the surface of the latent image bearer to form an electric charging nip therebetween and electrically charge the surface of latent image bearer uniformly, and a cleaning unit to remove residual toner remaining on the latent image bearer after the toner image is transferred onto a transfer medium in the transfer process. Further, the latent image bearer, the electric charging device, and the cleaning unit are integrated as a unit. With this, performance of replacing worn parts installed in a unit in which at least a deflective latent image bearer is installed and filming of foreign substances such as silica, etc., frequently occurs therein can be upgraded.

Numerous additional modifications and variations of the present invention are possible in light of the above teachings. It is therefore to be understood that within the scope of the appended claims, the present invention may be executed otherwise than as specifically described herein. For example, the image forming apparatuses are not limited to the above-described various embodiments and may be altered as appropriate. Similarly, the process cartridges are not limited to the above-described various embodiments and may be altered as appropriate.

What is claimed is:

1. An image forming apparatus comprising:

a rotatable latent image bearer;

a rotatable electric charging member to electrically charge the surface of the latent image bearer uniformly, the rotatable electric charging member contacting the surface of the latent image bearer to form an electric charging nip therebetween;

a latent image writing device to form an electrostatic latent image on the surface of the latent image bearer uniformly charged by the electric charging member;

a developing unit to apply toner to and develop the electrostatic latent image borne on the latent image bearer;

a transfer device to transfer a toner image rendered visible by the toner adhering to the latent image bearer onto a transfer medium in a transfer process;

a cleaning unit to remove residual toner remaining on the latent image bearer after the toner image is transferred onto the transfer medium in the transfer process; and an electric charging member cleaning unit to remove foreign substances adhering to the surface of the electric charging device, wherein a difference between the width of the electric charging nip in the direction of rotation at the longitudinal ends of the latent image bearer and that at the longitudinal center thereof is larger than an amount of deformation of the latent image bearer generated during rotation at the longitudinal center thereof.

2. The image forming apparatus as claimed in claim 1, wherein the difference between the width of the electric charging nip in the direction of rotation at the longitudinal ends of the latent image bearer and that at the longitudinal center is less than one-fifth of an average width of the electric charging nip in the direction of rotation.

3. The image forming apparatus as claimed in claim 1, wherein the electric charging member is a roller.

4. The image forming apparatus as claimed in claim 1, wherein a surface roughness Rz of the electric charging member is about 5 μm or more.

5. The image forming apparatus as claimed in claim 1, wherein the electric charging member contacts the surface of the latent image bearer below a rotational axis of the latent image bearer.

6. The image forming apparatus as claimed in claim 1, wherein both longitudinal ends of the electric charging member are pressed against the latent image bearer.

7. The image forming apparatus as claimed in claim 1, wherein an absolute value of an electric potential at the surface of the latent image bearer uniformly charged by the electric charging member is higher than ground potential by about 140 [V] or more.

8. The image forming apparatus as claimed in claim 1, wherein the cleaning unit comprises:

a cleaning blade to contact the surface of the latent image bearer to remove residual toner remaining after the transfer process; and a blade holder to fix the cleaning blade to a body of the image forming apparatus, wherein both longitudinal ends of the blade holder are fixed to the cleaning unit.

9. The image forming apparatus as claimed in claim 1, wherein a value obtained by dividing a moment of inertia of area of the latent image bearer by a cube of length of the latent image bearer ranges between 0.000058 [mm] and 0.000145 [mm]; and wherein a width of the electric charging nip in a direction of rotation at longitudinal ends of the latent image bearer is larger than that at a longitudinal center thereof.

10. A process cartridge attachable to a body of an image forming apparatus, the process cartridge comprising:

a rotatable latent image bearer;

a rotatable electric charging member to electrically charge the surface of latent image bearer uniformly, the electric charging member contacting the surface of the latent image bearer to form an electric charging nip therebetween; and a cleaning unit to remove residual toner remaining on the latent image bearer after the toner image is transferred onto a transfer medium in the transfer process, wherein the latent image bearer, the electric charging device, and the cleaning unit are a single unit wherein a difference between the width of the electric charging nip in a direction of rotation at longitudinal ends of the latent image bearer and that at a longitudinal center thereof is larger than an amount of deformation of the latent image bearer generated during rotation at the longitudinal center thereof.

11. The process cartridge of claim 10, wherein a difference between a width of the electric charging nip in a direction of rotation at longitudinal ends of the latent image bearer and that at a longitudinal center thereof is less than one-fifth of an average width of the electric charging nip in the direction of rotation.

12. The process cartridge of claim 10, wherein the electric charging member is a roller.

13. The process cartridge of claim 10, wherein a surface roughness Rz of the electric charging member is about 5 μm or more.

14. The process cartridge of claim 10, wherein the electric charging member contacts the surface of the latent image bearer below a rotational axis of the latent image bearer.

15. The process cartridge of claim 10, wherein both longitudinal ends of the electric charging member are pressed against the latent image bearer.

16. The process cartridge of claim 10, wherein an absolute value of an electric potential at the surface of the latent image bearer uniformly charged by the electric charging member is higher than the ground potential by about 140 [V] or more.

17. The process cartridge of claim 10, wherein the cleaning unit comprises:

a cleaning blade to contact the surface of the latent image bearer to remove residual toner remaining after the transfer process; and a blade holder to fix the cleaning blade to a body of the image forming apparatus, wherein both longitudinal ends of the blade holder are fixed to the cleaning unit.

18. An image forming apparatus comprising:

rotatable means for bearing a latent image on a surface thereof;

electric charging means for electrically charging the surface of the latent image bearing means uniformly, the electric charging means forming an electric charging nip between the latent image bearing means and the electric charging means by rotatably contacting the surface of the latent image bearing means;

means for writing and forming an electrostatic latent image on the surface of the latent image bearing means uniformly charged by the electric charging means;

means for applying toner to and developing the electrostatic latent image borne on the latent image bearing means;

means for transferring a toner image rendered visible by the toner adhering to the latent image bearing means onto a transfer medium in a transfer process;

means for removing residual toner remaining on the latent image bearing means after the toner image is transferred onto the transfer medium in the transfer process; and means for removing foreign substances adhering to the surface of the electric charging means, wherein a difference between the width of the electric charging nip in a direction of rotation at longitudinal ends of the latent image bearing means and that at a longitudinal center thereof is larger than an amount of deformation of the latent image bearing means generated at a longitudinal center thereof, and wherein a difference between the width of the electric charging nip in the direction of rotation at the longitudinal ends of the latent image bearing means and that at the longitudinal center thereof is larger than an amount of deformation of the latent image bearing means generated during rotation at the longitudinal center thereof.

19. The image forming apparatus as claimed in claim 18, wherein the difference between the width of the electric charging nip in the direction of rotation at the longitudinal ends of the latent image bearing means and that at the longitudinal center is less than one-fifth of an average width of the electric charging nip in the direction of rotation.

20. The image forming apparatus as claimed in claim 18, wherein a value obtained by dividing a moment of inertia of area of the latent image bearer by a cube of length of the latent image bearer ranges between 0.000058 [mm] and 0.000145 [mm]; and wherein a width of the electric charging nip in a direction of rotation at longitudinal ends of the latent image bearer is larger than that at a longitudinal center thereof.

* * * * *